US009039343B2

(12) United States Patent
Nishi et al.

(10) Patent No.: US 9,039,343 B2
(45) Date of Patent: May 26, 2015

(54) FRONT LOADER WITH INDICATOR ROD

(71) Applicant: Kubota Corporation, Osaka-shi (JP)

(72) Inventors: Ryoichi Nishi, Sakai (JP); Koji Saito, Sakai (JP); Kosuke Oyama, Sakai (JP); Kenzo Ushiro, Sakai (JP); Takahiro Yonekura, Sakai (JP)

(73) Assignee: Kubota Corporation, Osaka (JP)

( * ) Notice: Subject to any disclaimer, the term of this patent is extended or adjusted under 35 U.S.C. 154(b) by 179 days.

(21) Appl. No.: 13/775,470

(22) Filed: Feb. 25, 2013

(65) Prior Publication Data

US 2014/0064898 A1 Mar. 6, 2014

(30) Foreign Application Priority Data

Jul. 30, 2012 (JP) ..... 2012-168563

(51) Int. Cl.

| | |
|---|---|
| ***E02F 3/00*** | (2006.01) |
| ***E02F 9/26*** | (2006.01) |
| ***E02F 3/43*** | (2006.01) |
| ***E02F 3/34*** | (2006.01) |

(52) U.S. Cl.

CPC ..... *E02F 9/264* (2013.01); *E02F 3/433* (2013.01); *E02F 3/3417* (2013.01); *E02F 3/3408* (2013.01); *E02F 3/434* (2013.01); *E02F 9/265* (2013.01)

(58) Field of Classification Search

CPC ..... E02F 9/264; E02F 3/433; E02F 3/3411

USPC ..... 414/698

See application file for complete search history.

(56) References Cited

U.S. PATENT DOCUMENTS

| | | | | | |
|---|---|---|---|---|---|
| 2,372,220 | A | * | 3/1945 | Mork | 414/696 |
| 3,017,046 | A | * | 1/1962 | Runci et al. | 414/698 |
| 3,045,845 | A | * | 7/1962 | Hackett et al. | 414/698 |
| 3,141,563 | A | * | 7/1964 | Fisher | 414/698 |
| 3,198,360 | A | * | 8/1965 | Strader et al. | 414/698 |
| 3,251,493 | A | * | 5/1966 | Popelier | 414/698 |
| 3,275,174 | A | * | 9/1966 | Konefes | 414/698 |
| 3,695,474 | A | * | 10/1972 | Blakely | 414/700 |
| 3,710,968 | A | * | 1/1973 | Clevenger et al. | 414/698 |
| 3,796,335 | A | * | 3/1974 | Smith et al. | 414/698 |
| 4,119,212 | A | * | 10/1978 | Flemming | 414/698 |
| 4,277,899 | A | * | 7/1981 | Guthoff | 116/220 |
| 5,697,755 | A | * | 12/1997 | McCauley et al. | 414/698 |
| 6,099,235 | A | * | 8/2000 | Cain et al. | 414/694 |
| 6,325,590 | B1 | * | 12/2001 | Cain et al. | 414/699 |
| 6,447,240 | B1 | * | 9/2002 | Cain et al. | 414/694 |
| 7,413,397 | B2 | * | 8/2008 | Muramoto et al. | 414/686 |

FOREIGN PATENT DOCUMENTS

| | | |
|---|---|---|
| JP | 200628934 A | 2/2006 |

* cited by examiner

*Primary Examiner* — Gerald McClain
(74) *Attorney, Agent, or Firm* — The Webb Law Firm

(57) ABSTRACT

A front loader is provided with an indicator device. The indicator device is configured to indicate that the work implement is in an identical posture irrespective of a height position of the work implement, by aligning a rear end of the indicator rod with a rear end of the guide tube.

5 Claims, 31 Drawing Sheets

(a)

(b)

FRONT LOADER WITH INDICATOR ROD

BACKGROUND OF THE INVENTION

1. Field of the Invention

The present invention relates to a front loader mounted in front of a travelling vehicle.

2. Description of the Related Art

One known example of such a front loader mounted in front of a travelling vehicle is a front loader described in JP 2006-028934 A (or U.S. Pat. No. 7,413,397 B2 corresponding thereto).

The front loader comprises:

a main frame standing erect in front of the travelling vehicle;

a boom having a rear end thereof pivotably supported at an upper portion of the main frame to be vertically movable; and a work implement pivotably supported at a front end of the boom to effect scooping and dumping operations.

The front loader further comprises an indicator device for indicating that the work implement is in a horizontal posture (e.g. a posture where the bottom surface of the work implement is horizontal) while the work implement is contacted on the ground.

The indicator device has an indicator rod operable in association with the scoop and dumping operation of the work implement; and a guiding device for guiding an intermediate portion of the indicator rod to be movable in an axial direction thereof.

The indicator rod is arranged along a forward portion of the boom on a upper-forward side of the boom; and a front end thereof is pivotably supported by a pivot shaft for pivotably supporting a front end of a work implement cylinder for driving the work implement. In operation, the indicator rod is moved rearward in the axial direction by the scooping operation of the work implement, and is moved forward in the axial direction by the dumping operation of the work implement.

The guiding device is provided at a longitudinal intermediate portion of the boom, and has an insertion portion for receiving the indicator rod so that the indicator rod is movable in the axial direction.

An index portion is provided at the intermediate portion of the indicator. In operation, while the work implement is moved upward away from the ground, the work implement is pivoted to align the index portion of the indicator rod to the insertion portion of the guiding device; and in this state, bringing the work implement into contact with the ground causes the work implement to come into contact with the ground in a horizontal posture.

The indicator device of the conventional front loader indicates that the work implement is in a horizontal posture only when the work implement is in contact with the ground, and does not indicate that the work implement is in the same posture at any height position.

As such, when an operator has to manipulate the work implement while checking the posture of the work implement with his/her own eye in order to place the work implement in the same posture at any height position while operating the boom upward or downward. Therefore, it is difficult to perform a work in which an angle of the work implement is important, such as a work for vertically moving the boom while keeping the posture of the work implement at the same posture (e.g. a horizontal posture), such as a pallet fork work.

Further, the operator recognizes that the work implement is in a horizontal posture while contacted on the ground by visually checking that the index portion of the indicator rod is aligned with the insertion portion of the guiding device. However, with the aforementioned indicator device, since the indicator rod is disposed along the forward portion of the boom at the upper forward portion of the boom and the guiding device for receiving and guiding the indicator rod is provided at the longitudinal intermediate portion of the boom, the visually checking position by the operator is distant from the operator and is difficult to visually observe.

In view of these inconveniences, an object of the present invention is to provide a front loader provided with an indicator device whereby the foregoing problems are solved.

SUMMARY OF THE INVENTION

The above object is fulfilled according to a following configuration of the invention as under:

A front loader comprising:

a main frame standing erect in front of the travelling vehicle;

a boom having a rear end thereof pivotably supported at an upper portion of the main frame to be vertically movable;

a work implement pivotably supported at a front end of the boom to effect scooping and dumping operations; and an indicator device for indicating a posture of the work implement, the indicator device including:

- a guide tube extending along a longitudinal direction of the boom on a rear portion of the boom;
- a tube support mechanism provided on the rear portion of the boom, the tube support mechanism supporting the guide tube so that the guide tube is movable in an axial direction thereof;
- a boom interlocking link having a rear end thereof pivotably supported by the main frame and a front end thereof operatively coupled to the tube support mechanism so that the guide tube moves in an axial direction thereof in association with vertical movement of the boom;
- an indicator rod inserted into the guide tube to be movable in the axial direction of the guide tube;
- a rod support mechanism provided at a longitudinal intermediate portion of the boom for supporting the indicator rod so that the indicator rod is movable in an axial direction thereof; and
- a work implement interlocking mechanism for interlocking the bucket and the rod support mechanism so that the indicator rod is movable in the axial direction thereof in association with the scooping operation and the dumping operation of the work implement;

wherein the indicator device is configured to indicate that the work implement is in an identical posture irrespective of a height position of the work implement, by aligning a rear end of the indicator rod with a rear end of the guide tube.

According to this configuration, vertical movement of the boom is accompanied by movement of the guide tube in the axial direction with respect to the indicator rod. Swinging the work implement causes the indicator rod to move in the axial direction with respect to the guide tube. As such, when the boom is moved vertically, scoop-operating or dump-operating the work implement aligns the rear end of the indicator rod with the rear end of the guide tube. Also, aligning the rear end of the indicator rod with the rear end of the guide tube indicates that the work implement is in the same posture at any height position. Whereby, aligning the rear end of the indicator rod with the rear end of the guide tube when the boom is vertically moved maintains the work implement at the same posture while the boom is moved vertically.

As described above, the indicator device is configured to align the rear end of the indicator rod with the rear end of the guide tube to thereby indicate that the work implement is at the same posture at any height. The operator visually checks for whether or not the rear end of the indicator rod is aligned with the rear end of the guide tube.

In the present configuration, the tube support mechanism for supporting the guide tube is provided on the rear side of the boom, the rod support mechanism for supporting the indicator rod is provided at the longitudinal intermediate portion of the boom, and the work implement and the rod support mechanism are interlocked by the work implement interlocking mechanism. Thus, the guide tube and the indicator rod can be arranged on the rear side of the boom along the longitudinal direction of the boom. Whereby, the visual check position of the indicator device can be brought closer to the operator, to facilitate the visual check by the operator.

According to one preferred embodiment, the front loader further comprises:

a boom cylinder for hydraulically operating the boom upward and downward;

a work implement cylinder for hydraulically effecting the scooping and dumping operations of the work implement; and a spill guard control device for automatically dump-operating the work implement to prevent scooped object having scooped up by the work implement from falling out of the bucket to the rear side when the boom is being elevated without manually operating the work implement, the spill guard control device including:

a spill guard valve for switching routes of hydraulic oil to automatically dump-operate the work implement;

the work implement interlocking mechanism;

an engaging portion provided at the work implement interlocking mechanism; and a valve operating mechanism for coming into engagement with the engaging portion and actuating the spill guard valve before the work implement reaches a posture in which the scooped object in the work implement will fall out to the rear side.

According to the above configuration, a portion (some components) of the configuration for the spill guard control device is shared with a portion of the configuration for the indicator device for maintaining the work implement posture. Thus, the number of components as well as resulting costs can be reduced and the outer appearance can be simplified, when providing the front loader with the indicator device for maintaining the work implement posture and the spill guard control device for preventing the spilling out of scooped object.

According to another preferred embodiment, the front loader further comprises:

a second indicator device for indicating that the work implement is at a horizontal posture where a bottom surface thereof is horizontal with the work implement being in contact with the ground, the second indicator device including:

an index portion provided on the rod support mechanism for moving in unison with the indicator rod; and a mark member provided on the boom side;

wherein the work implement is in contact with the ground in a horizontal posture by scoop-operating or dump-operating the work implement until the index portion comes into alignment with the mark member in the longitudinal direction of the boom, and bringing the work implement into contact with the ground.

According to the above configuration, the second indicator device for indicating that the work implement is in a horizontal posture where the bottom surface thereof is horizontal when the work implement is brought into contact with the ground is shared with a portion (some components) of the configuration for the (first) indicator device for maintaining posture. Thus, the number of components can be reduced as well as resulting costs, and the outer appearance can be simplified, when providing to the front loader with the indicator device for maintaining the work implement posture and the second indicator device.

According to still another preferred embodiment, a rear end surface of the guide tube forms an inclined surface with respect to an axis of the guide tube, and a rear end surface of the indicator rod is forms an inclined surface with respect to an axis of the indicator rod, the inclined surface of the indicator rod being flush with to align the rear end surface of the guide tube.

According to the above configuration, the rear end surface of the guide tube and the rear end surface of the indicator rod forms inclined surfaces which are inclined with respect to the respective axes thereof. Thus, it is easier for the operator to visually observe a distal end of the rear end side of the indicator rod from behind, when the rear end surface of the indicator rod approaches the rear end surface of the guide tube from inside the guide tube. Further, it is easier to be known that the rear end side of the indicator rod approaches the rear end surface of the guide tube, and therefore it is easier to align the respective positions of the rear end surface of the indicator rod and the rear end surface of the guide tube.

According to still yet another preferred embodiment, a notch portion is provided at the rear end of the guide tube by cutting away a portion in the peripheral direction thereof by a predetermined range, forwardly from the rear end.

According to the above configuration, the notch portion is formed by cutting out a predetermined range of a portion in the peripheral direction thereof from the rear end toward the front, on the rear end side of the guide tube; and that the rear end side of the indicator rod is exposed to the outside. This enhances visibility of the indicator device.

Other characteristic configurations and advantages and effects invited therefrom will be apparent by reading the following description with reference to accompanying drawings.

DESCRIPTION OF THE PREFERRED EMBODIMENTS

Figure 1:
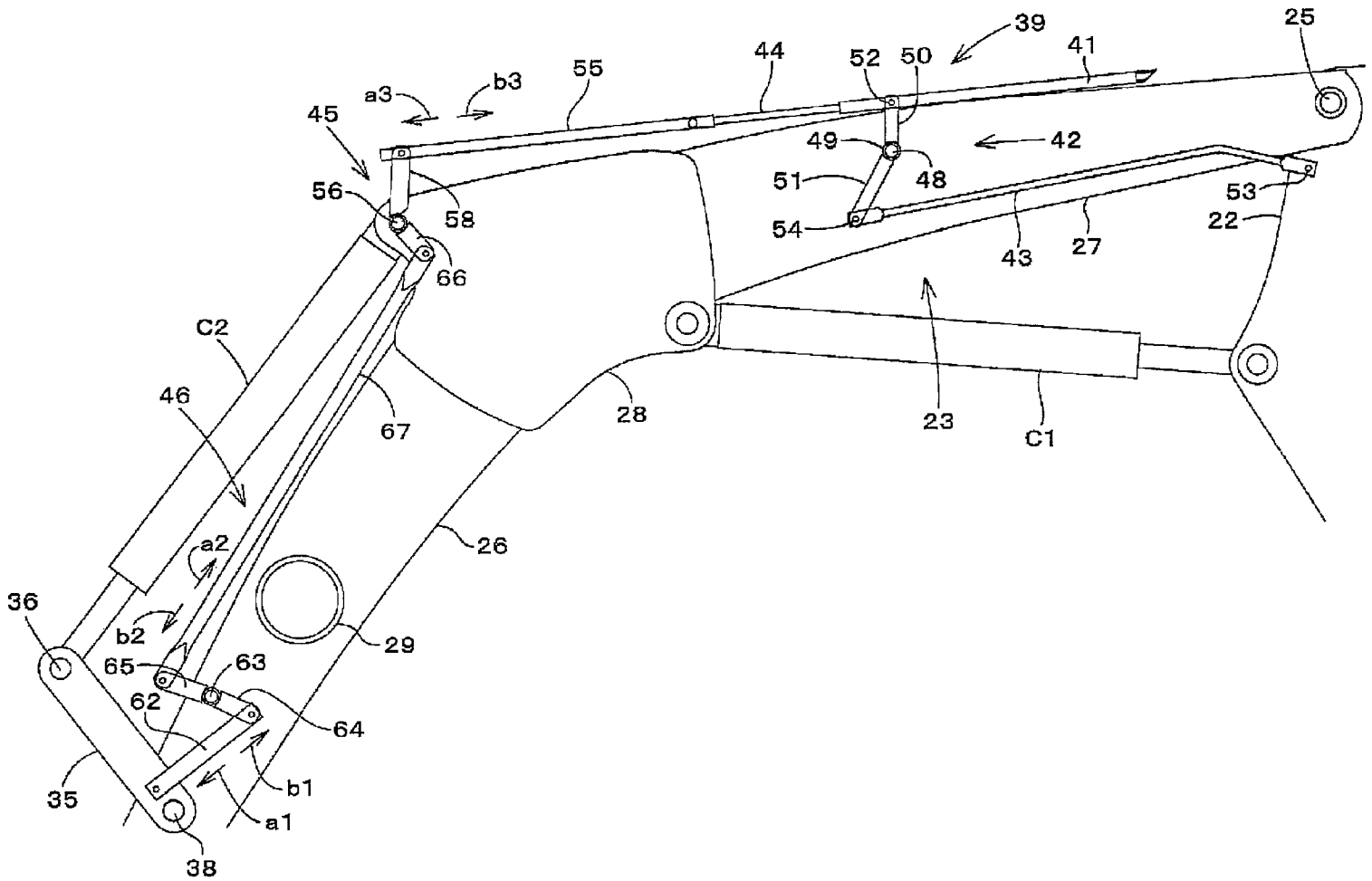
FIG. 1 is a side view showing an indicator device according to a first embodiment (same through to FIG. 14)

Embodiments of the present invention will be described hereinafter with reference to the accompanying drawings.

First Embodiment

FIGS. 1 to 14 show a first embodiment. With reference to FIG. 7, reference numeral "1" denotes a work vehicle, so-called a "TLB" (tractor, loader and backhoe) which is presented as one example of a work vehicle. The work vehicle (TLB) includes a tractor 2 acting as travelling vehicle, a front loader 3 mounted in front of the tractor 2 and a backhoe 4 mounted on a rearward portion of the tractor 2.

The tractor 2 is a two-axle four-wheel tractor 2 having a vehicle body 7 supported for travelling by a right/left pair of front wheels 5 and a right/left pair of rear wheels 6. The vehicle body 7 of the tractor 2 is formed by coupling a power transmission case 9 to the rearward portion of an engine 8; and the power transmission case 9 is formed by directly interconnecting a clutch housing, a transmission case and a differential case, for example.

A driver's seat 10 is provided at the rearward portion of the vehicle body 7. Rear wheel fenders 14 for covering the rear wheels 6 is provided on right/left sides of the driver's seat 10; and a steering wheel 11 is provided on the front side of the driver's seat 10. A hood 12 is provided on the front side of the steering wheel 11 for covering the engine 8. In addition to the engine 8, the hood 12 houses a radiator, a battery, a fuel tank and the like, which are supported by a front axle frame 13 extending forward from the bottom of the engine 8.

Provided on the vehicle body 7 of the tractor 2 are a front loader mounting frame 16 for mounting the front loader 3 thereon, and a backhoe mounting frame 17 for mounting the backhoe 4 thereon.

Figure 8:
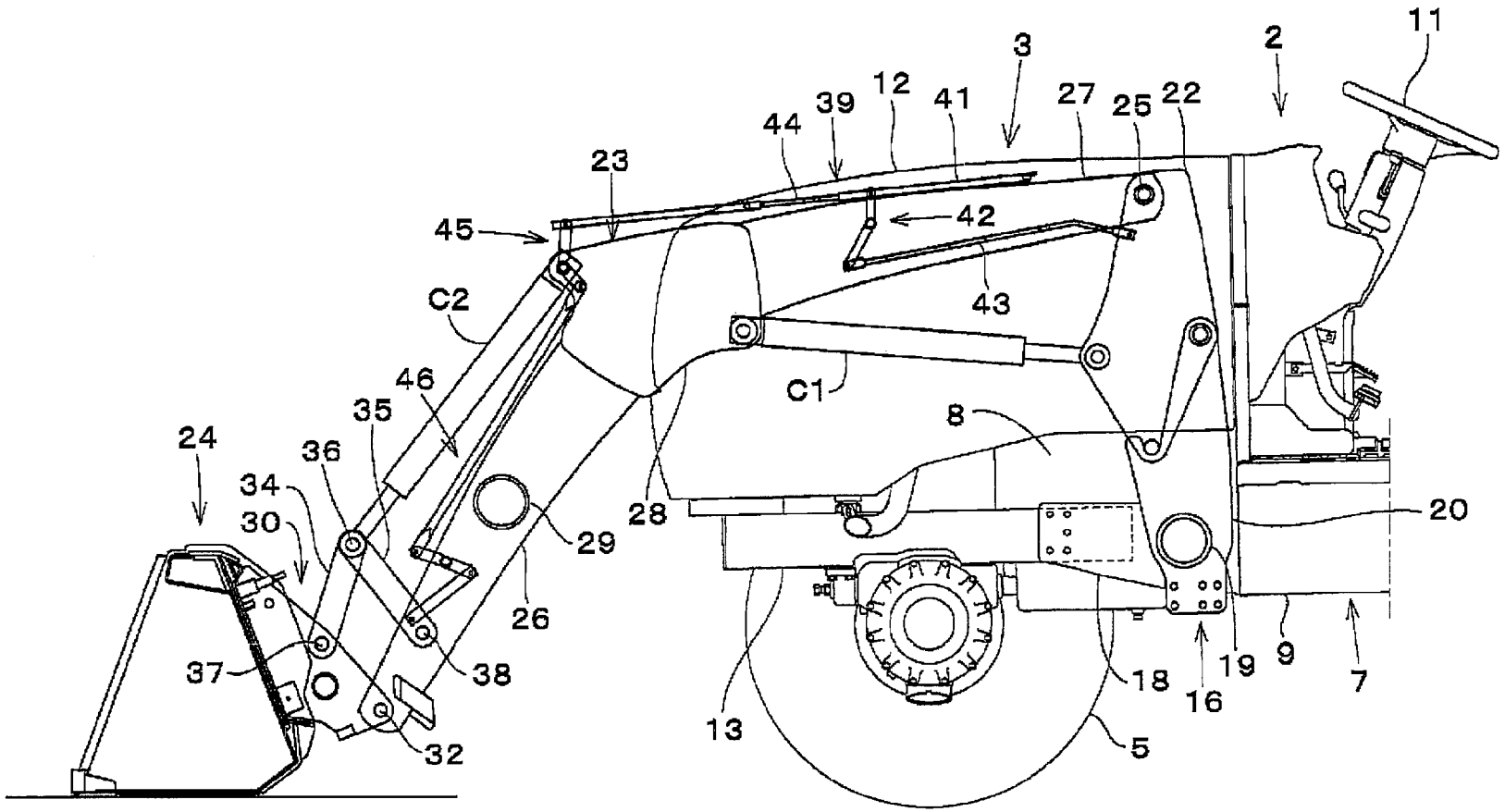
FIG. 8 is a side view of a forward portion of a tractor.
Figure 9:
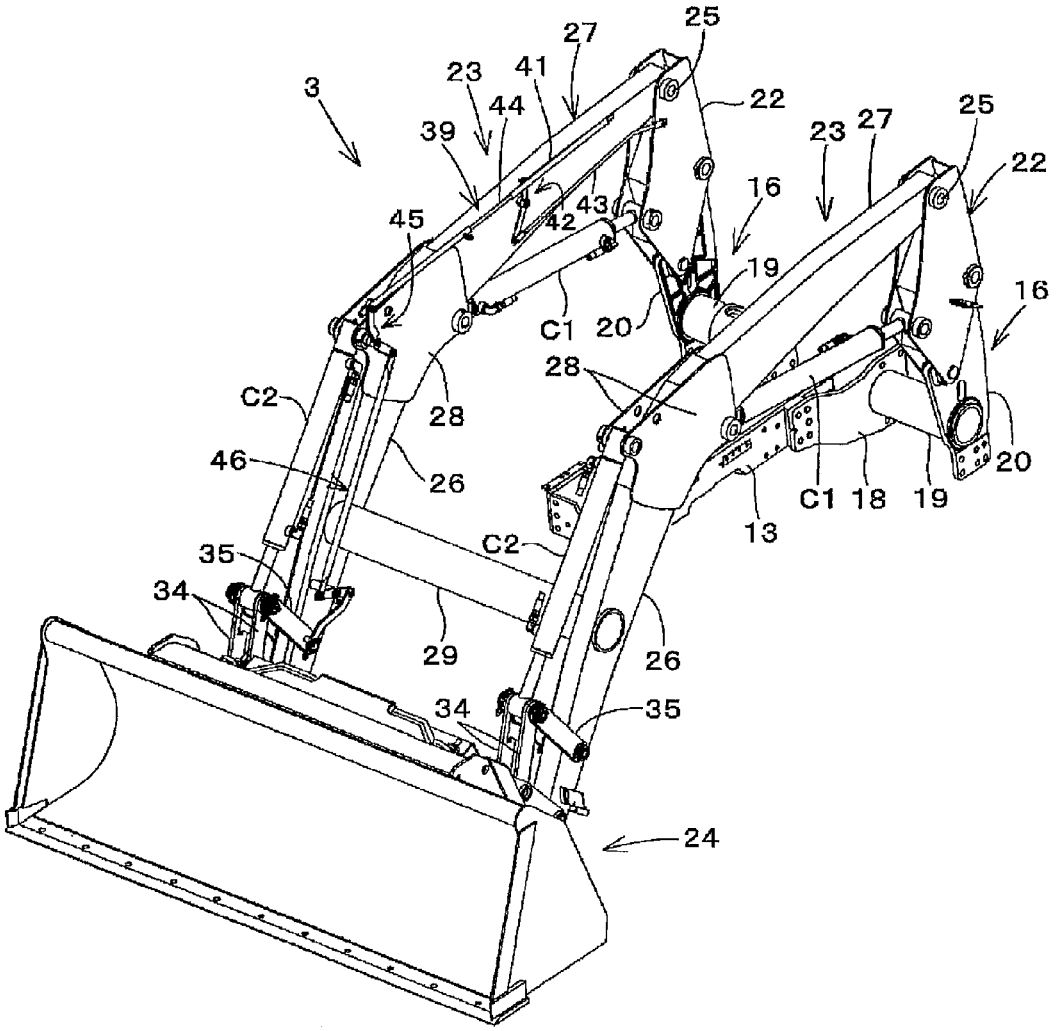
FIG. 9 is a perspective view of a front loader.

The front loader mounting frame 16 is provided on a front right/left side of the vehicle body 7. As shown in FIGS. 8 and 9, the front loader mounting frame 16 includes an attachment bracket 18 fixed by bolts to the front axle frame 13 and the vehicle body 7; a support base 19 comprising a pipe member extending outwardly in the transverse direction from the attachment bracket 18; and a mast 20 provided upright at the outer end of the support base 19 in the transverse direction.

As shown in FIG. 7, the backhoe mounting frame 17 extends from the forward portion to the rearward portion of the vehicle body 7, and is arranged on the right/left side of the vehicle body 7. The front end of the backhoe mounting frame 17 is fixed by bolts to the lower end of the mast 20 associated therewith in the transverse direction. A rear portion of the right/left backhoe mounting frame 17 is fixed to the rearward portion of the vehicle body 7. The rear end of the right/left backhoe mounting frame 17 acts as a backhoe attaching section 21 for detachably attaching the backhoe 4.

As shown in FIGS. 8 and 9, the front loader 3 has a right/left pair of main frames 22, a right/left pair of booms 23 and a bracket 24 (a work implement).

The main frames 22 and the booms 23 are positioned on and extending across the right/left sides of the hood 12 of the tractor 2; and the bucket 24 is positioned in front of the hood 12.

The right/left main frame 22 is detachably attached to the mast 20 of the backhoe mounting frame 17 associated therewith in the transverse direction.

The rear end (proximal end) of the right/left boom 23 is pivotably supported to be rotatable about a transverse axis, via a boom support shaft 25 at an upper portion of the main frame 22 associated therewith in the transverse direction, thus enabling up/down swinging.

Each boom 23 includes, as primary components thereof, a front boom member 26, a rear boom member 27 and a right/left pair of coupling plates 28 for coupling the front/rear boom members 26, 27.

As shown in FIG. 8, with the bucket 24 in contact with the ground, the rear boom member 27 extends forward from the upper portion of the main frame 22, and from the front side of the hood 12, the front boom member 26 extends downward toward a forward end thereof. Thus, the boom 23 describes a shape that is bent at an intermediate portion. The front boom members 26 of the right and left booms 23 are coupled by a boom coupling member 29 made of a pipe member.

A boom cylinder C1 comprising double acting hydraulic cylinder is arranged under the right/left rear boom member 27. The rear end of the boom cylinder C1 is pivotably coupled to a lower portion of the main frame 22, and the front end of the boom cylinder C1 is pivotably coupled to a longitudinal intermediate portion of the boom 23 (the coupling plate 28). Thus, the booms 23 are operated upward when the boom cylinders C1 are extended, and the booms 23 are operated downward when the boom cylinders C1 are retracted.

A work implement mounting frame 30, having the transverse width spanning the right and left booms 23, is detachably attached to the front end (distal end) of the right/left boom 23. The work implement mounting frame 30 is pivotably coupled to the front end of the right/left boom 23 via a work implement pivot shaft 32 associated therewith, be rotatable about the transverse axis.

The bucket 24 is detachably attached to the work implement mounting frame 30. The bucket 24 is swung up and down about the axis of the work implement pivot shaft 32 (an upward swinging operation of the bucket 24 will be also referred to as "a scooping operation", and a downward swinging operation of the bucket 24 will be also referred to as "a dumping operation").

In the front loader 3 of the present embodiment, work implements other than the bucket 24 (e.g. a distal end attachment such as a pallet fork) can be easily attached via the work implement mounting frame 30.

A bucket cylinder C2 (working implement cylinder), comprising a double acting hydraulic cylinder, is arranged above the right/left front boom member 26. The rear end of the bucket cylinder C2 is pivotably coupled to the longitudinal intermediate portion of the boom 23 (the coupling plate 28) via a cylinder support shaft 33 (see FIG. 4).

One end of a first work implement link 34 and one end of a second work implement link 35 are pivotably coupled to the front end of the bucket cylinder C2 via a pivot shaft 36. The other end of the first work implement link 34 is pivotably coupled to the work implement mounting frame 30 via a pivot shaft 37. The other end of the second work implement link 35 is pivotably coupled to the booms 23 via a pivot shaft 38, on the rear side of the work implement pivot support shaft 32.

In operation, the bucket 24 is scoop-operated (operated upward) when the bucket cylinders C2 are extended, while the bucket 24 is dump-operated (operated downward) when the bucket cylinders C2 are retracted.

The front loader 3 includes an indicator device 39 for maintaining bucket posture (for maintaining work implement posture), whereby it is indicated that the bucket 24 is at the same posture when the booms 23 are positioned at any height.

As shown in FIG. 9, the indicator device 39 extends substantially along the right boom 23 inside of the boom 23 in the transverse direction, and close to an inner side of the right boom 23 in the transverse direction.

Figure 2:
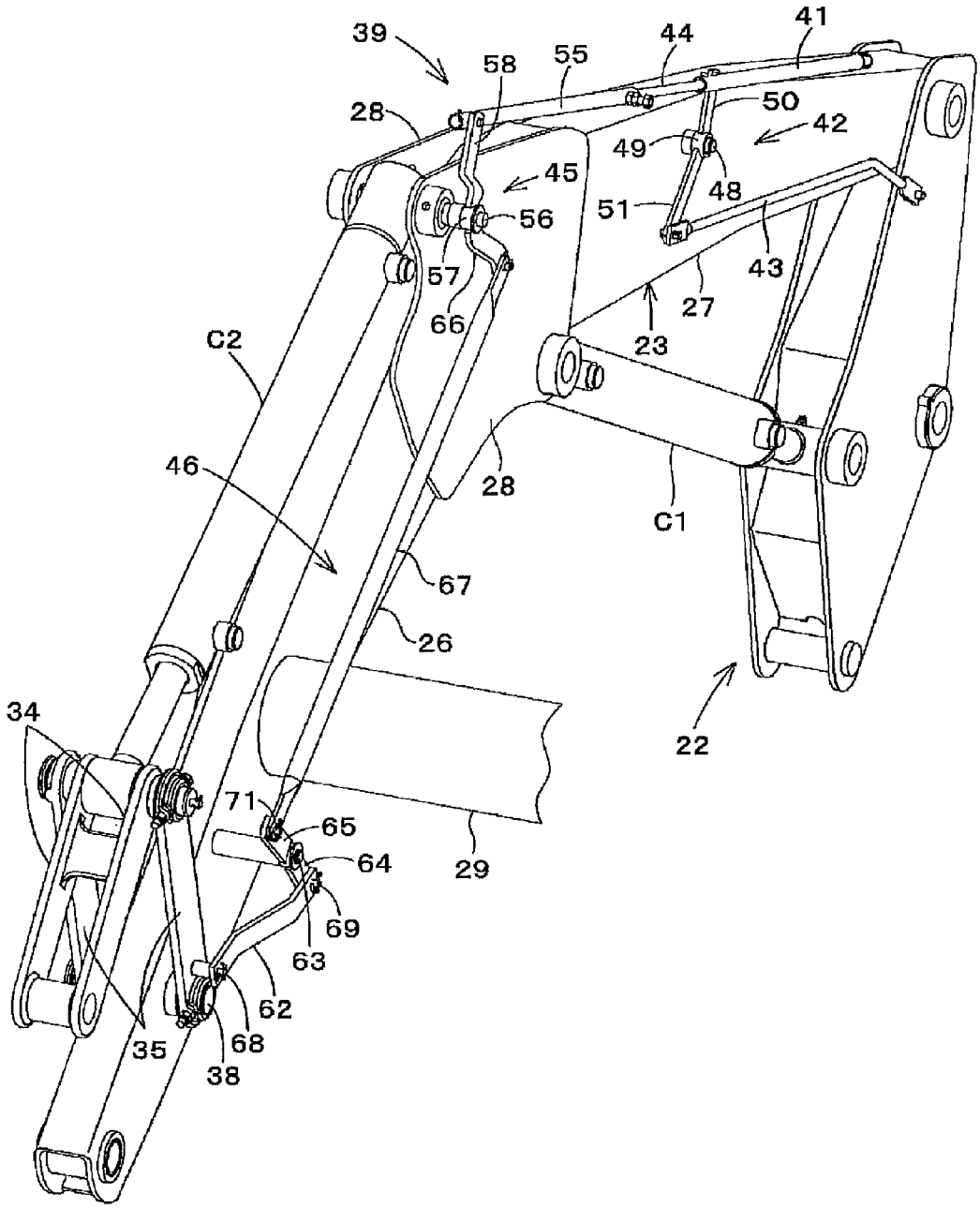
FIG. 2 is a perspective view showing the indicator device.

As shown in FIGS. 1 and 2, the indicator device 39 includes: a guide tube 41 arranged on the rear portion of the boom 23; a tube support mechanism 42 for supporting the guide tube 41 so that the guide tube 41 is movable in the axial direction thereof; a boom interlocking link 43 having a rear end thereof pivotably supported by the main frame 22 and a front end thereof operatively coupled to the tube support mechanism 42; an indicator rod 44 inserted into the guide tube 41 to be movable in the axial direction of the guide tube 41; a rod support mechanism 45 for supporting the indicator rod 44 so that the indicator rod 44 is movable in the axial direction thereof; and a work implement interlocking mechanism 46 for interlocking the bucket 24 and the rod support mechanism 45 so that the indicator rod 44 is movable in association with vertical motion of the bucket 24 in association with the upward and downward swinging operations (i.e. the scooping operation and the dumping operation) of the work implement.

The guide tube 41 is formed of a cylindrical member having opened opposite ends in the axial direction. The guide tube 41 is arranged along the longitudinal direction of the boom 23 on top of the rearward portion of the boom 23 (of the rear boom member 27).

Figure 6:
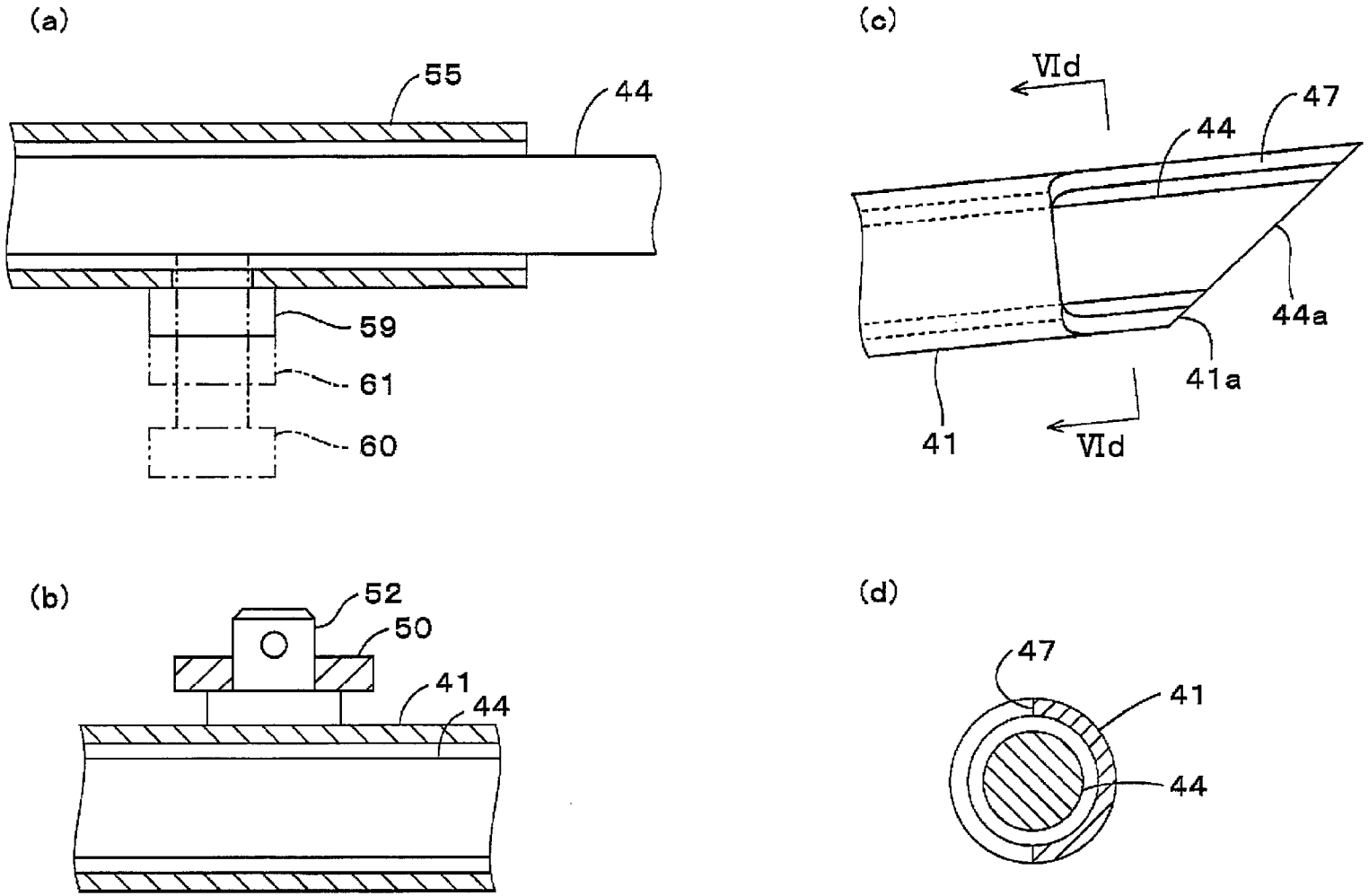
FIG. 6 shows portions of the indicator device, in which (*a*) is a partial plan view in section of a portion "X" in FIG. 5, (*b*) is a partial plan view in section of a portion "Y" in FIG. 5; (*c*) is a side view of a rear end of a guide tube, and (*d*) is a view in section taken along a line VId-VId line in FIG. 6 (*c*)
Figure 7:
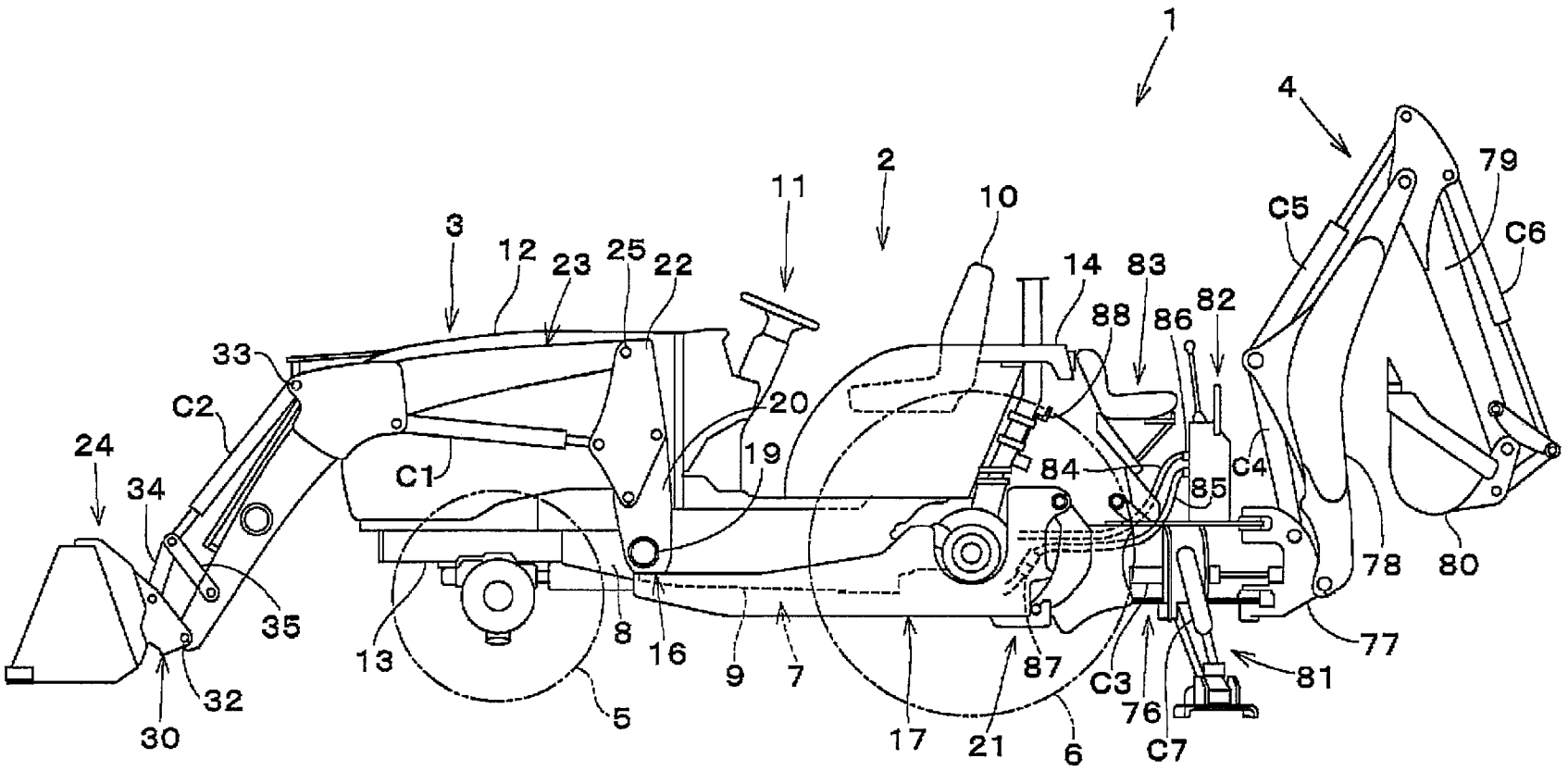
FIG. 7 is an overall side view of a work vehicle.

As shown in FIG. 6 (*c*), the rear end of the guide tube 41 is cut by a plane inclined with respect to the axial direction of the guide tube 41, to thereby form an inclined surface with respect to the axial direction of the guide tube 41. The rear end surface 41*a* of the guide tube 41 is formed to provide a downward-facing.

As shown in FIG. 6 (*c*) and FIG. 6 (*d*), a notch portion 47 formed at the rear end of the guide tube 41 by partially cutting away in the peripheral direction by a predetermined range, forwardly from the rear end thereof. In the illustrated embodiment, a left half of the rear end of the guide tube 41 is cut away.

As shown in FIG. 1, the tube support mechanism 42 is arranged inside the rearward portion of the right boom 23 (the rear boom member 27) in the transverse direction, and somewhat offset forward from a longitudinal center of the rearward portion of the right boom 23.

Figure 4:
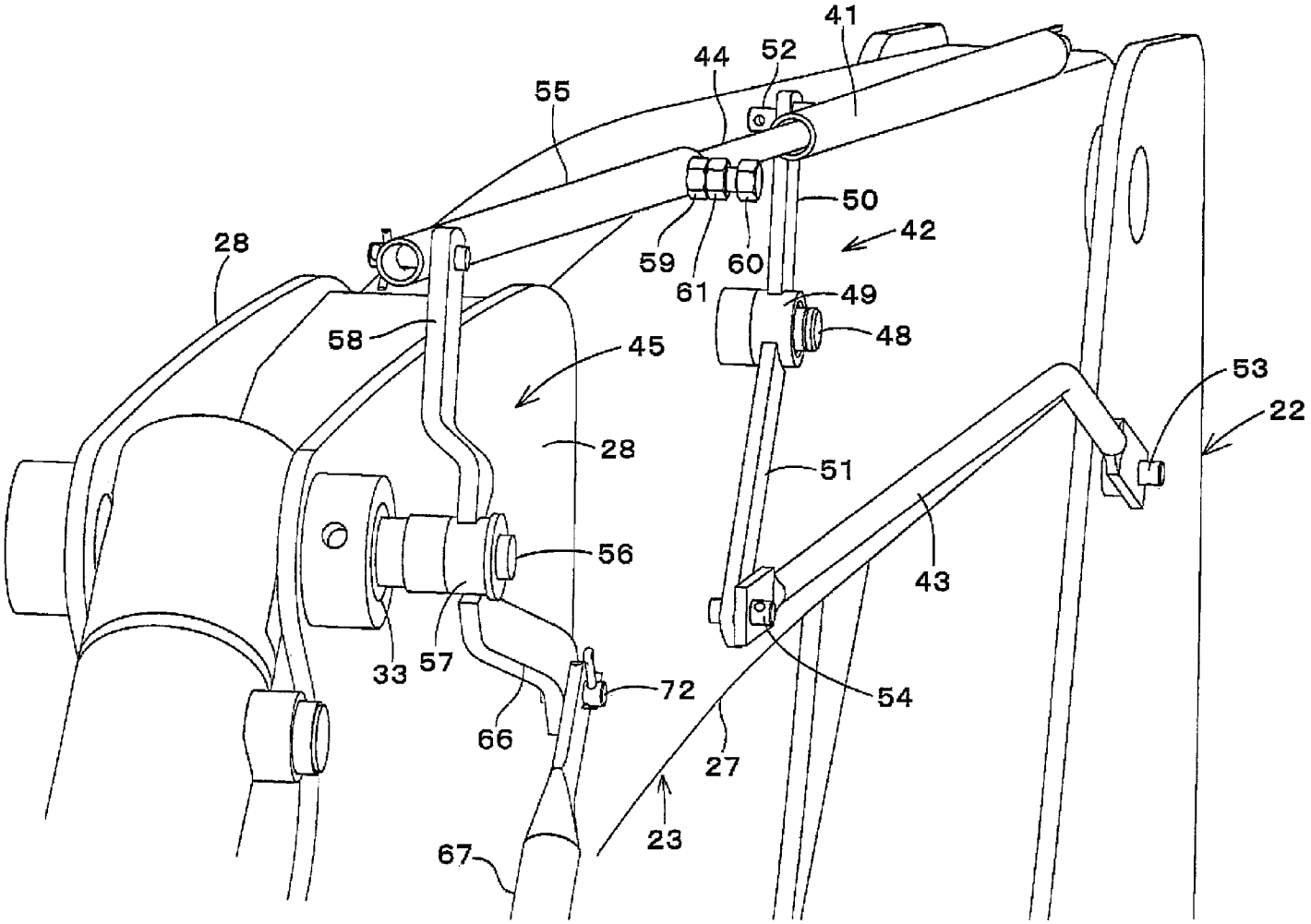
FIG. 4 is a perspective view showing from an intermediate portion to a rear portion of the indicator device.
Figure 5:
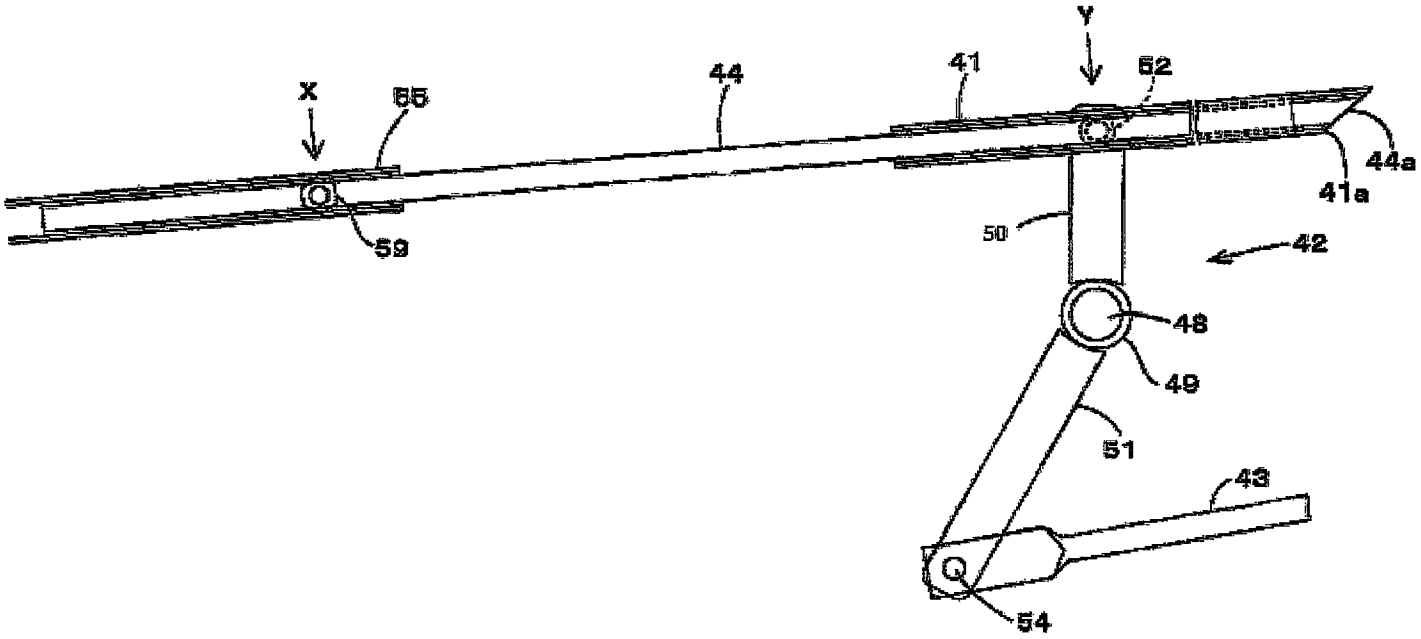
FIG. 5 is an enlarged side view of a portion of the indicator device.

As shown in FIGS. 4 and 5, the tube support mechanism 42 includes: a rotating support shaft 48 fixed to a lateral side of the boom 23 and having a transverse axis; a boss 49 externally fitted on and supported by the rotating support shaft 48 to be rotatable about the transverse axis; a support arm 50 extending radially outward and upward from the boss 49; and a rotating arm 51 extending radially outward and downward from the boss 49.

As shown in FIG. 1, a distal end (extending end) of the support arm 50 is pivotably coupled to the rearward portion of the guide tube 41 to be rotatable about a transverse axis. More specifically, as shown in FIGS. 5 and 6 (*b*), a support shaft 52 having a transverse axis is fixed to a right surface of the guide tube 41, and a distal end of the support arm 50 is pivotably coupled to the support shaft 52.

As shown in FIG. 4, the rear end of the boom interlocking link 43 is pivotably supported by the main frame 22 to be rotatable about a transverse axis, via a rear pivot pin 53 which is provided below the boom support shaft 25 and fixed to the main frame 22. The front end of the boom interlocking link 43 is pivotably coupled via a front pivot pin 54 to the distal end (the extending end) of the rotating arm 51 to be rotatable about the transverse axis.

As shown in FIG. 5, the indicator rod 44 comprises a cylindrical rod, and having a rear end thereof inserted into the guide tube 41 to be movable in the axial direction of the guide tube 41. As shown in FIG. 6 (*c*), a rear end surface 44*a* of the indicator rod 44 forms an inclined surface cut by a plane extending parallel to the rear end surface 41*a* of the guide tube 41.

In the following description, the rear end surface 44*a* of the indicator rod 44 will be referred to as a "posture indicating portion", and the rear end surface 41*a* of the guide tube 41 will be referred to as a "mark portion".

When the posture indicating portion 44*a* is aligned with the mark portion 41*a*, the posture indicating portion 44*a* becomes flush with the mark portion 41*a*, to thereby indicate that the bucket 24 is at the same posture when the boom 23 is at any height position.

As shown in FIGS. 1 and 4, the rod support mechanism 45 is arranged at the longitudinal intermediate portion of the boom 23. The rod support mechanism 45 includes: a rod support member 55 for fixing and supporting the forward portion of the indicator rod 44; a rotating support shaft 56 provided on the boom 23 side and having a transverse axis; a boss 57 externally fitted on and supported by the rotating support shaft 56 to be rotatable about the transverse axis; and a swinging arm 58 extending radially outward from the boss 57 and having a distal end (extending end) thereof pivotably coupled to the rearward portion of the rod support member 55 to be rotatable about a transverse axis.

As shown in FIG. 5, the forward portion of the indicator rod 44 is inserted into the rod support member 55 to be movable in the axial direction thereof. A nut member 59 is fixed to the forward portion of the rod support member 55. The nut member 59 is fixed to the rod support member 55 so that an axis of a screw hole thereof extends in a direction orthogonal to an axis of the rod support member 55.

As shown in FIG. 6 (*a*), a fixing bolt 60 is provided on the rod support member 55 to be threaded into the nut member 59 and extends through the rod support member 55 to abut against the indicator rod 44.

By screwing and fastening the fixing bolt 60, the indicator rod 44 is fixed to the rod support member 55 not to be movable in the axial direction thereof. By unscrewing and loosening the fixing bolt 60, the indicator rod 44 becomes movable in the axial direction with respect to the rod support member 55, whereby the indicator rod 44 is adjusted in position in the axial direction with respect to the rod support member 55.

Further, a locknut 61 is provided between the nut member 59 and the head of the fixing bolt 60 for regulating the looseness of the fixing bolt 60.

As shown in FIG. 4, the rotating support shaft 56 is provided concentric with the cylinder support shaft 33 for pivotably supporting the rear end of the bucket cylinder C2.

As shown in FIGS. 1 and 2, the work implement interlocking mechanism 46 includes: a detection link 62 arranged on the front end of the boom 23 for detecting a swinging action of the bucket 24; a first interlocking arm 64 which rotatably swings about a transverse axis via a rotating support shaft 63 which is fixed to the boom 23; a second interlocking arm 65 which swings in unison with the first interlocking arm 64; a third interlocking arm 66 which swings in unison with the swinging arm 58 of the rod support mechanism 45; and a coupling link 67 for operatively coupling the second interlocking arm 65 and the third interlocking arm 66.

Figure 3:
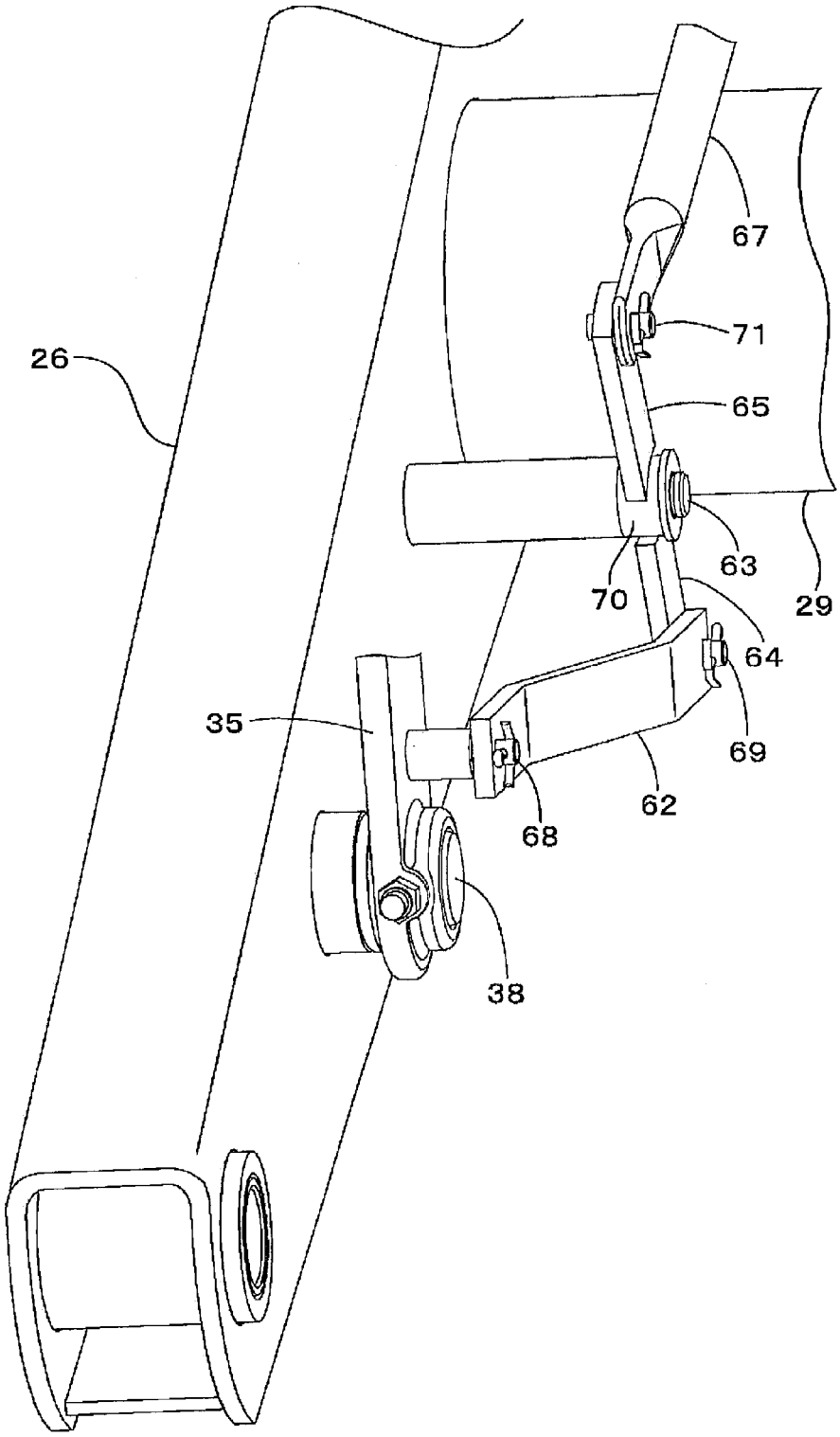
FIG. 3 is a perspective view showing a forward portion of the indicator device.

As shown in FIG. 3, the detection link 62 has a front end thereof pivotably supported by and coupled to the second work implement link 35 via a link pin 68 at a higher position than the pivot shaft 38 which pivotably supports the other end of the second work implement link 35. On the other hand, the detection link 62 has a rear end thereof pivotably supported by and coupled to a distal end of the first interlocking arm 64 via a link pin 69.

The rotating support shaft 63 is arranged on the rear side of the second work implement link 35, and a boss 70 is externally fitted on the rotating support shaft 63 to be rotatable about the axis. A distal portion of the first interlocking arm 64 and a distal portion of the second interlocking arm 65 are fixed to the boss 70.

As shown in FIG. 4, a distal portion of the third interlocking arm 66 is fixed to the boss 57 having the swinging arm 58 of the rod support mechanism 45 fixed thereto.

As shown in FIG. 3, the coupling link 67 has a forward end thereof pivotably supported by and coupled to a distal end of the second interlocking arm 65 via a link pin. As shown in FIG. 4, the coupling link 67 has a rear end thereof pivotably supported by and coupled to a distal end of the third interlocking arm 66 via a link pin 72.

As shown in FIG. 1, in operation of the indicator device 39 configured as described above, when the bucket 24 is dump-operated, the detection link 62 is pulled forward (in the direction of the arrow a1). This causes the first interlocking arm 64 and the second interlocking arm 65 to swing in unison to push the coupling link 67 rearward (in the direction of the arrow a2). When the coupling link 67 is pushed in the direction of the arrow a2, the third interlocking arm 66 and the swinging arm 58 swing in unison and the rod support member 55 is pulled forward (in the direction of the arrow a3). This causes the indicator rod 44 to move forward in the axial direction thereof.

When the bucket 24 is scoop-operated, the detection link 62 is pushed rearward (in the direction of the arrow b1). This causes the first interlocking arm 64 and the second interlocking arm 65 to swing in unison and causes the coupling link 67 to be pulled forward (in the direction of the arrow b2). When the coupling link 57 is pulled in the direction of the arrow b2, the third interlocking arm 66 and the swinging arm 58 swing in unison and the rod support member 55 is pushed rearward (in the direction of the arrow b3), and this causes the indicator rod 44 to move rearward in the axial direction thereof.

Thus, swinging the bucket 24 moves the indicator rod 44 in the axial direction thereof relative to the guide tube 41, whereby the posture indicating portion 44*a* of the rear end of the indicator rod 44 can be aligned to the mark portion 41*a* of the rear end of the guide tube 41.

In the illustrated embodiment, when the posture indicating portion 44*a* of the indicator rod 44 is aligned with the mark portion 41*a* of the guide tube 41, the bucket 24 is set to become in a horizontal posture (a posture where the bottom surface of the bucket 24 is horizontal).

Figure 10:
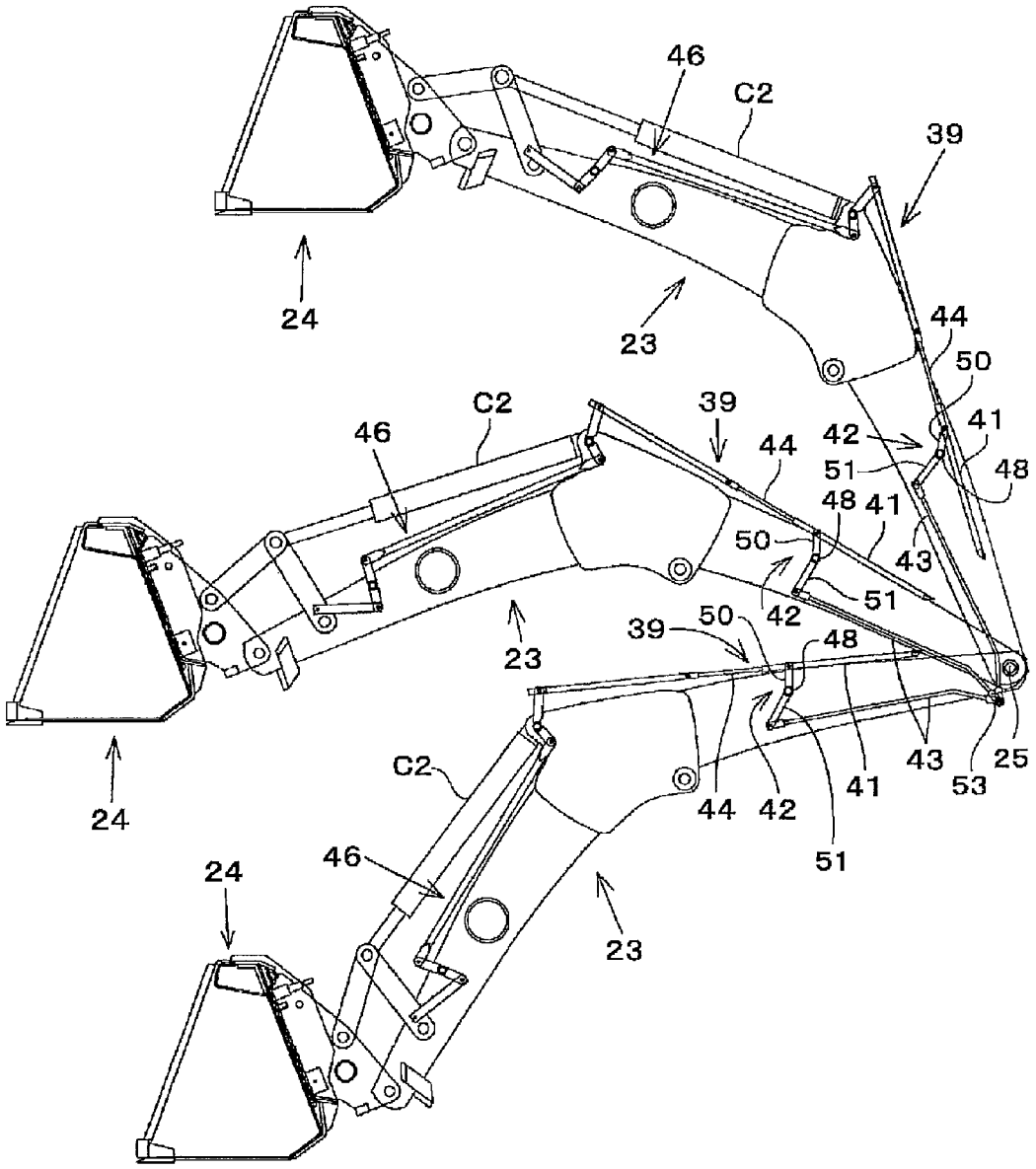
FIG. 10 is a view explaining an swinging operation of a boom.

In the indicator device 39, the rear pivot support pin 53 for pivotably supporting the rear end of the boom interlocking link 43 is positioned below the boom support shaft 25. Thus, as shown in FIG. 10, when the boom 23 is swung upward about the boom support shaft 25 from a state where the bucket 24 is contacted with the ground, the rotating support shaft 48 of the tube support mechanism 42 moves away from the rear pivot support pin 53. Also, the rear end of the boom interlocking link 43 is pivotably supported by the main frame 22, and thus the rotating arm 51 swings rearward and the support arm 50 swings forward. Whereby, the guide tube 41 moves forward in the axial direction.

When the bucket 24 is not swung in course of these operations, the upward swinging of the boom 23 is accompanied by an increasingly rearward tilt of the bucket 24, and by the rear end of the indicator rod 44 projecting from the guide tube 41.

In view whereof, when the boom 23 is swung upward, the bucket 24 is dump-operated, the indicator rod 44 is moved forward and, as shown in FIG. 5, the posture indicating portion 44*a* of the indicator rod 44 is aligned with the mark portion 41*a* of the guide tube 41. Then, the bucket 24 becomes a horizontal posture.

When the boom 23 is swung downward from an elevated state, the guide tube 41 is conversely moved rearward in the axial direction, and therefore the bucket 24 is scoop-operated, the indicator rod 44 is moved rearward, and the posture indicating portion 44*a* of the indicator rod 44 is aligned with the mark portion 41*a* of the guide tube 41.

In these manners, aligning the posture indicating portion 44*a* of the indicator rod 44 with the mark portion 41*a* of the guide tube 41 makes it possible to maintain the bucket 24 in a horizontal posture at any height position, and also makes it possible for the operator to easily maintain the horizontal posture of the bucket 24 by visually checking the posture indicating portion 44*a*.

With the indicator device 39, the position of the indicator rod 44 can be adjusted with respect to the rod support member 55 in the axial direction, and thus the bucket 24 can be set to maintain not only a horizontal posture but also an inclined posture (a posture where the bottom surface of the bucket 24 is inclined by a predetermined angle with respect to the horizontal).

To carry out this setting, for example, the bucket 24 is first swung vertically to reach a desired incline posture. In this state, the fixing bolt 60 is loosened to allow movement of the indicator rod 44 in the axial direction with respect to the rod support member 55, and to align the posture indicating portion 44*a* of the indicator rod 44 with the mark portion 41*a* of the guide tube 41 so that the posture indicating portion 44*a* of the indicator rod 44 becomes flush with the mark portion 41*a* of the guide tube 41. The fixing bolt 60 is fastened in this state, rendering the indicator rod 44 immovable in the axial direction with respect to the rod support member 55.

Whereby, aligning the posture indicating portion 44*a* of the indicator rod 44 with the mark portion 41*a* of the guide tube 41, regardless of whether the boom 23 is being raised or lowered, makes it possible to maintain the posture of the bucket 24 so that the bucket 24 will be at the same incline posture at any height position.

In the indicator device 39, the guide tube 41 is arranged on the rearward portion of the boom 23 and along the longitudinal direction of the boom 23, and therefore a mark position (visual check position) of the indicator device 39 can be placed close to the operator, thus allowing the operator to more easily perform the visual check.

Figure 11:
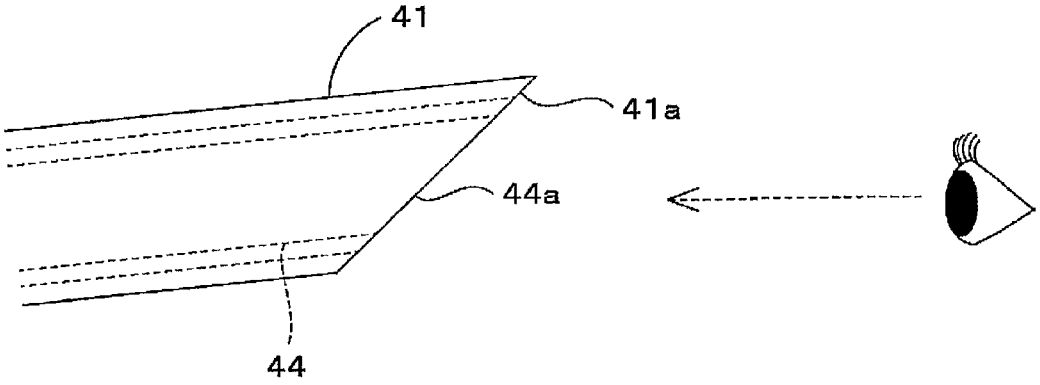
FIG. 11 is a side view showing a modification of respective rear end portions of the guide tube and the indicator rod.
Figure 11:
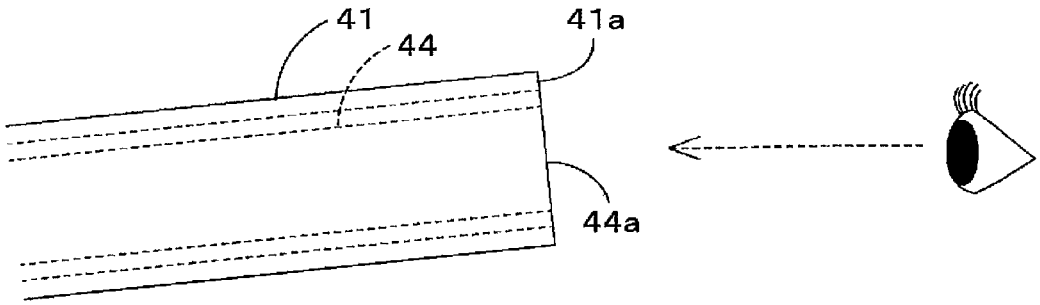

The present invention is not limited to the foregoing embodiment. As shown in FIG. 11 (*b*), the rear end surface 44*a* of the indicator rod 44 and the rear end surface 41*a* of the guide tube 41 may be cut on a plane orthogonal to the axial direction. However, in the illustration in FIG. 11 (*b*), the posture indicating portion 44*a* of the rear end of the indicator rod 44 is positioned inside the guide tube 41, and it is difficult to know the position of the posture indicating portion 44*a*, because the posture indicating portion 44*a* approaches the mark portion 41*a* of the guide tube 41 from inside the guide tube 41 when the posture indicating portion 44*a* is moved rearward from the guide tube 41 to be aligned with the position of the mark portion 41*a* of the guide tube 41. Also, when the posture indicating portion 44*a* ends up projecting from the mark portion 41*a* of the guide tube 41, it is then necessary to move the posture indicating portion 44*a* forward, and in some cases the operation becomes cumbersome.

In view whereof, as shown in FIG. 11 (*a*), if the rear end surfaces 44*a*, 41*a* of the indicator rod 44 and the guide tube 41 are cut on a plane inclined with respect to the axial direction, and if the posture indicating portion 44*a* is positioned inside the guide tube 41 and approaches the mark portion 41*a* of the guide tube 41 from inside the guide tube 41, it is then possible for the operator to visually observe, from the rear side, the distal end of the rear end of the indicator rod 44. This makes it easier to know that the rear end of the indicator rod 44 is approaching to the rear end surface of the guide tube 41, and to align the positions of the posture indicating portion 44*a* and the mark portion 41*a*.

Also, compared with the embodiment in FIG. 11 (*a*), visibility for the operator is further enhanced, when the rear end of the guide tube 41 is partially cut away and exposed as shown in FIG. 6 (*c*) and FIG. 6 (*d*) so that the indicator rod 44 is visible to the operator at the rear end of the guide tube 41.

Figure 12:
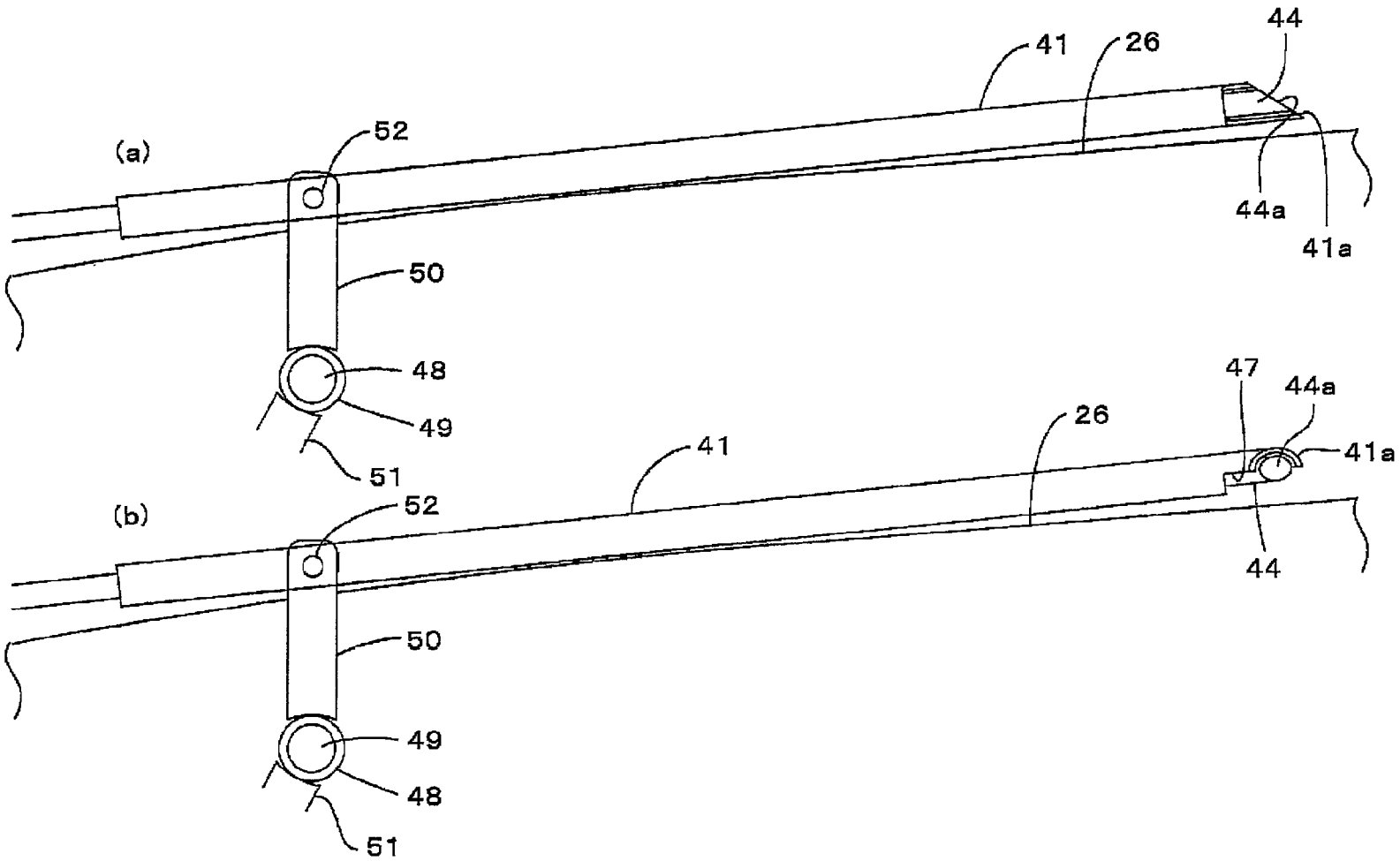
FIG. 12 is a side view showing a mode of arrangement for the guide tube and the indicator rod.

In the foregoing embodiment, the cutting plane of the rear ends of the indicator rod 44 and the guide tube 41 is downward facing, but this is not limitative. For example, as shown in FIG. 12 (*a*), the cutting plane of the rear ends of the indicator rod 44 and the guide tube 41 may also be upward facing, or as shown in FIG. 12 (*b*), the cutting plane of the rear ends of the indicator rod 44 and the guide tube 41 may be laterally facing.

With reference to FIG. 7, the backhoe 4 includes: a proximal base 76 detachably attached to the backhoe attaching section 21 of the backhoe mounting frame 17; a swing bracket 77 supported at a rearward portion of the proximal base 76 to be swingable right and left about a vertical axis; a boom 78 supported by the swing bracket 77 to be rotatable about a transverse axis; an arm 79 supported by a distal end of the boom 78 to be rotatable about the transverse axis; a bucket 80 supported by a distal end of the arm 79 to be rotatable about the transverse axis; an outrigger 81 provided on a right/left side of the proximal base 76; a maneuvering device 82 provided on the proximal base 76; and a maneuver seat 83.

The swing bucket 77 is driven by a swing cylinder C3. The boom 78 is driven by a boom cylinder C4. The arm 79 is driven by an arm cylinder C5. The bucket 80 is driven by a bucket cylinder C6. The outrigger is driven by an outrigger cylinder C7.

The maneuvering device 82 is adapted for manipulating each of the hydraulic cylinders C3 to C7 provided on the backhoe 4, and includes a control valve for controlling any one of the hydraulic cylinders C3 to C7.

The control valve receives hydraulic oil via a delivery hose 84 from a hydraulic pump provided on the tractor 2. The hydraulic oil is returned toward a tank on the tractor 2 via a return hose 85 from the control valve.

The delivery hose 84 extends from the tractor 2 and is detachably connected to the maneuvering device 82 via a hydraulic joint 86. The return hose 85 extends from the maneuvering device 82 and is detachably connected to a hydraulic joint 87 provided at the rear end of the tractor 2.

When the backhoe 4 is dismounted from the tractor 2, the return hose 85 remains on the backhoe 4 side, and the delivery hose 84 is dismounted from the maneuvering device 82 and is fixed to the tractor 2 side.

The fixation of the delivery hose 84 to the tractor 2 side involves a method of fixation using a clamp band, but clamp band fixation has problems such as that "removal is cumbersome" and "age-related (secular) degradation results in the clamp band tearing off.

Figure 13:
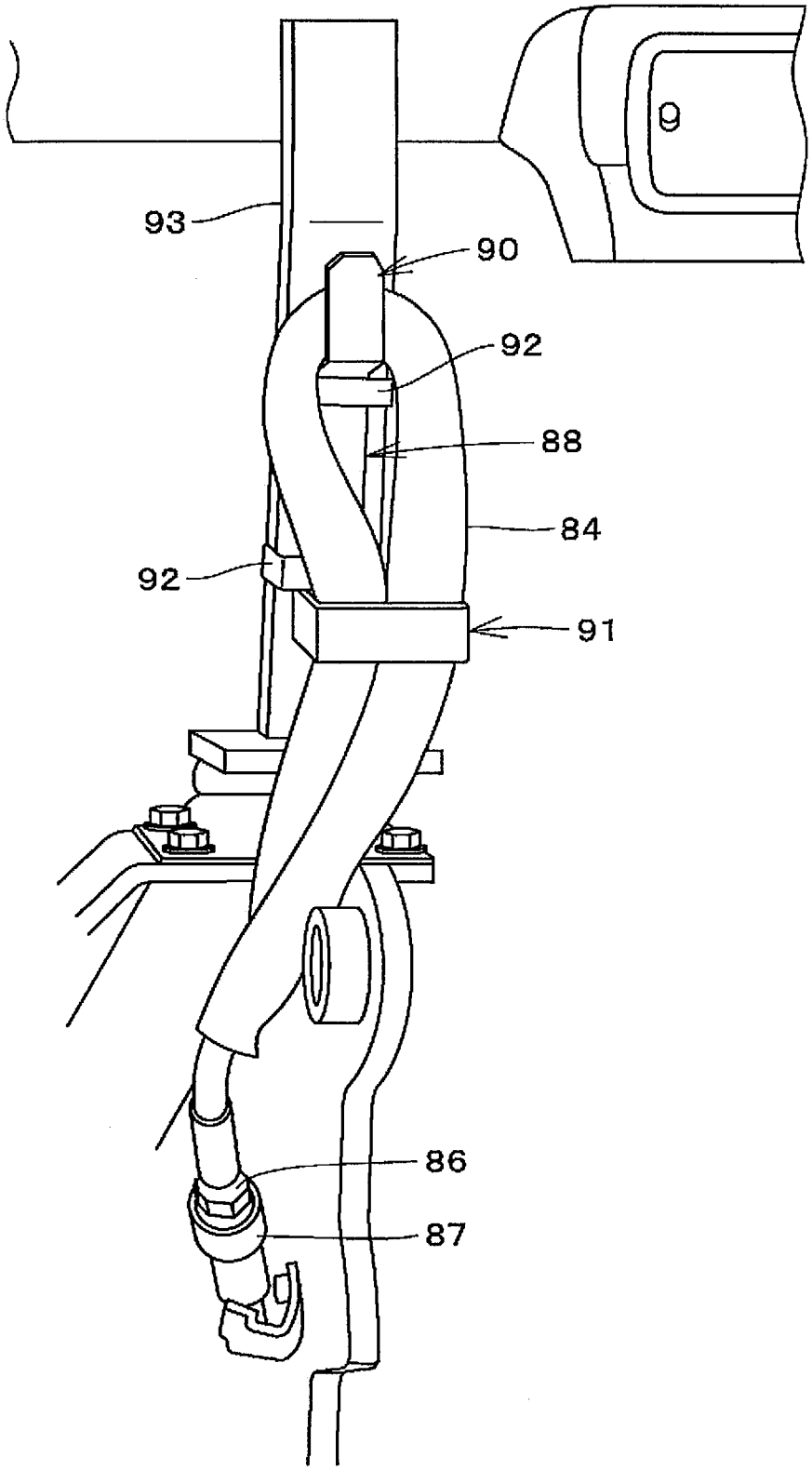
FIG. 13 is a rear side perspective view showing a delivery hose held by a hose guide.
Figure 14:
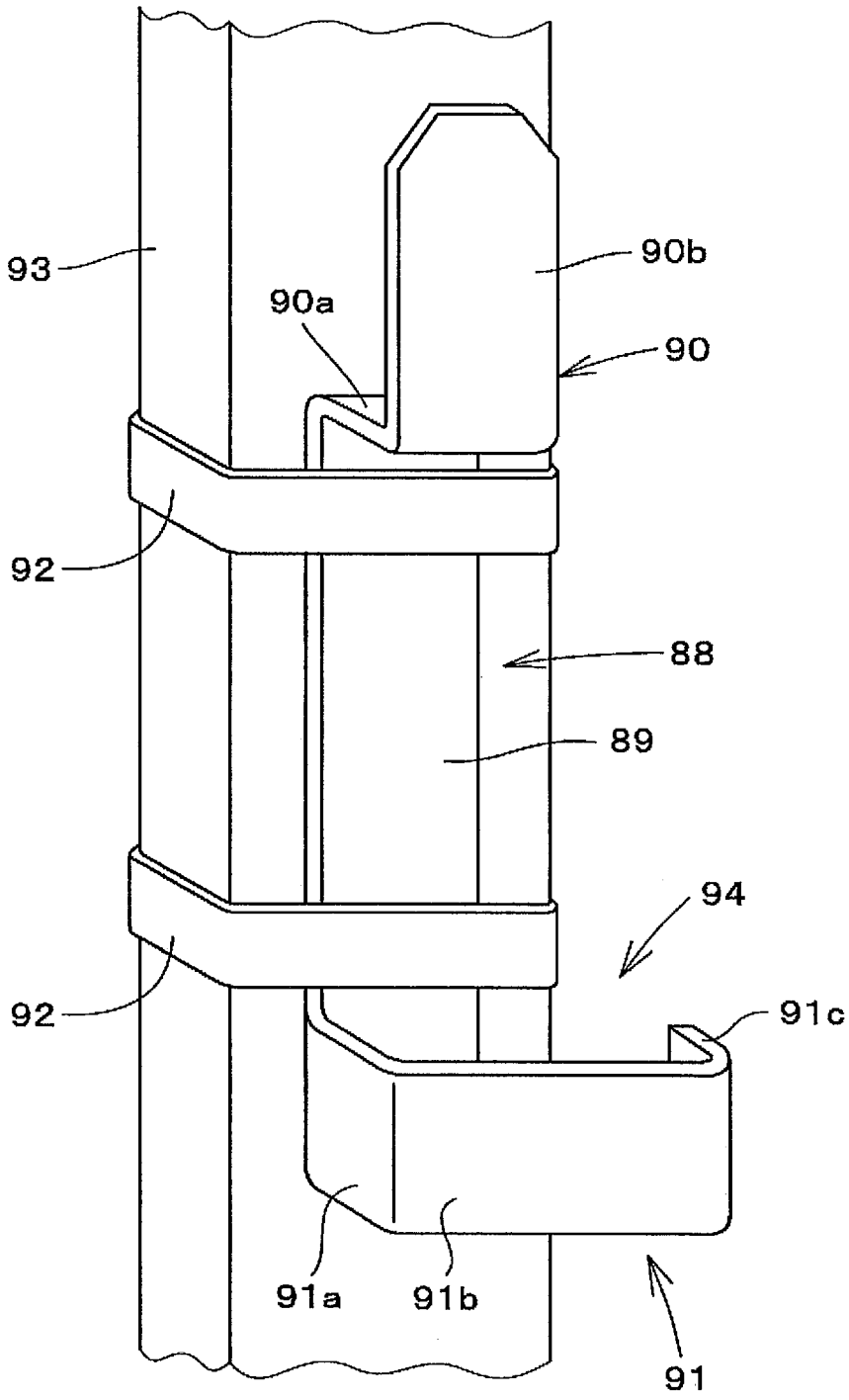
FIG. 14 is a rear side perspective view of the hose guide.

In view whereof, in the TBL 1 in the present embodiment, as shown in FIGS. 7, 13, and 14, a hose holder 88 made of a metal plate is provided at the rear end of the tractor 2, so that the delivery hose 84 is held by the hose holder 88.

As shown in FIG. 14, the hose holder 88 includes a base portion 89; a hooking portion 90 provided at an upper portion of the base portion 89; and a regulation portion 91 provided to at a lower portion of the base portion 89.

The base portion 89 is attached to a strut member 93 by a band 92. The strut member 93 may be provided by a lower portion of a ROPS (rollover protection structure), for example (However, a member or a method for attaching the base portion 89 is not limited thereto).

The hooking portion 90 is constituted of a lower wall 90*a* extending rearward from the upper end of the base portion 89, and an upright wall 90*b* extending upward from the rear end of the lower wall 90*a*. The regulation portion 91 includes a side wall 91*a* extending rearward from a side edge of the lower end of the base portion 89, a rear wall 91*b* extending laterally from the rear end of the side wall 91*a*, and a locking wall 91*c* extending forward from the extending side end portion of the rear wall 91*b*. The rear wall 91*b* juts laterally from the strut member 93, and the locking wall 91*c* is formed with a narrower longitudinal width than the width of the side wall 91*a*. As such, a clearance 94 for hose passage is formed between the rear portion of the locking wall 91*c* and the strut member 93.

To fix the delivery hose 84 to the hose holder 88, as shown in FIG. 13, the front side of the delivery hose 84 is placed into the regulation portion 91 and hooked onto the hooking portion 90. Thereafter, the rear side of the delivery hose 84 is placed into the regulation portion 91, and the hydraulic joint 86 on the rear end of the delivery hose 84 is connected to the hydraulic joint 87 to which the return hose 85 is connected. In the illustrated embodiment, the delivery hose 84 is covered with a covering member.

With the hose holder 88, the delivery hose 84 is easily fixed and is easily removed from the hose holder 88; and moreover since the hose holder 88 is made of a metal plate, long-term usage is possible.

Second Embodiment

FIGS. 15 to 19 show a second embodiment.

The second embodiment is different from the first embodiment in that the front loader 3 includes a spill guard control device 96; and that a portion of the configuration for the spill guard control device 96 acts also as a portion of the configuration for the indicator device 39.

The indicator device 39 and other configurations are configured substantially similar to those of the first embodiment.

The spill guard control device 96 is used when the operator elevates the boom 23 without operating (manually manipulating) the bucket 24 for preventing scooped object inside the bucket 24, such as earth or sand having scooped by the bucket 24, from falling (spilling) out of the bucket 24 on the rear side due to an automatic dumping operation (downward operation) of the bucket 24 effected before the scooped object falls out on the rear side.

The spill guard control device 96 includes, as primary components thereof, a spill guard valve SV for switching hydraulic oil routes to automatically dump-operate the bucket 24; and a spill guard operating mechanism 97 for detecting the posture of the bucket 24 and activating the spill guard valve SV before the bucket 24 reached a posture whereby the scooped object in the interior thereof would fall out on the rear side.

Figure 15:
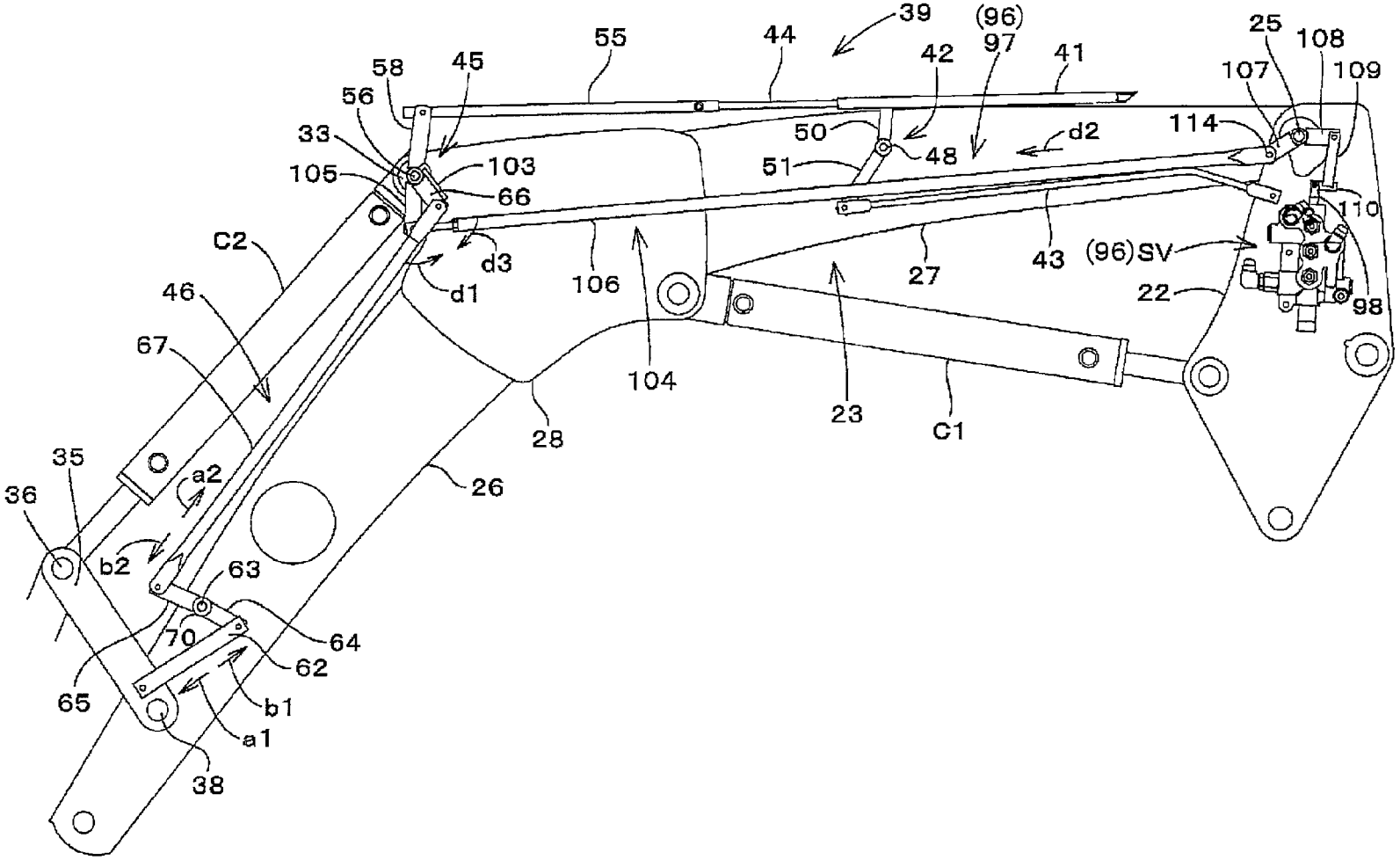
FIG. 15 is a side view showing an indicator device and a spill guide control device according to a second embodiment (same through to FIG. 19)
Figure 16:
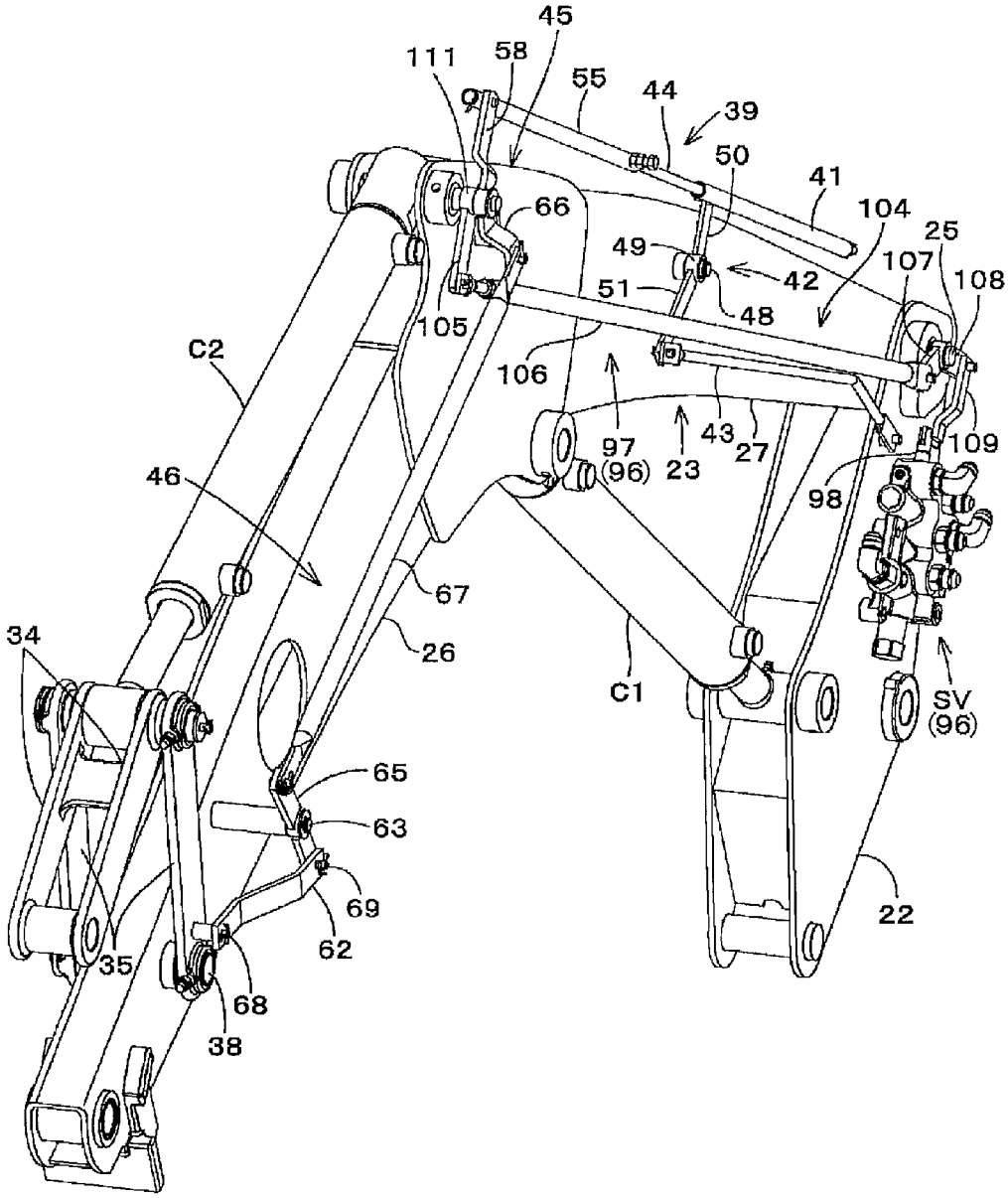
FIG. 16 is a perspective view showing the indicator device and the spill guide control device.

As shown in FIGS. 15 and 16, the spill guard valve SV is attached and fixed to a left side surface of the right main frame 22.

Figure 19:
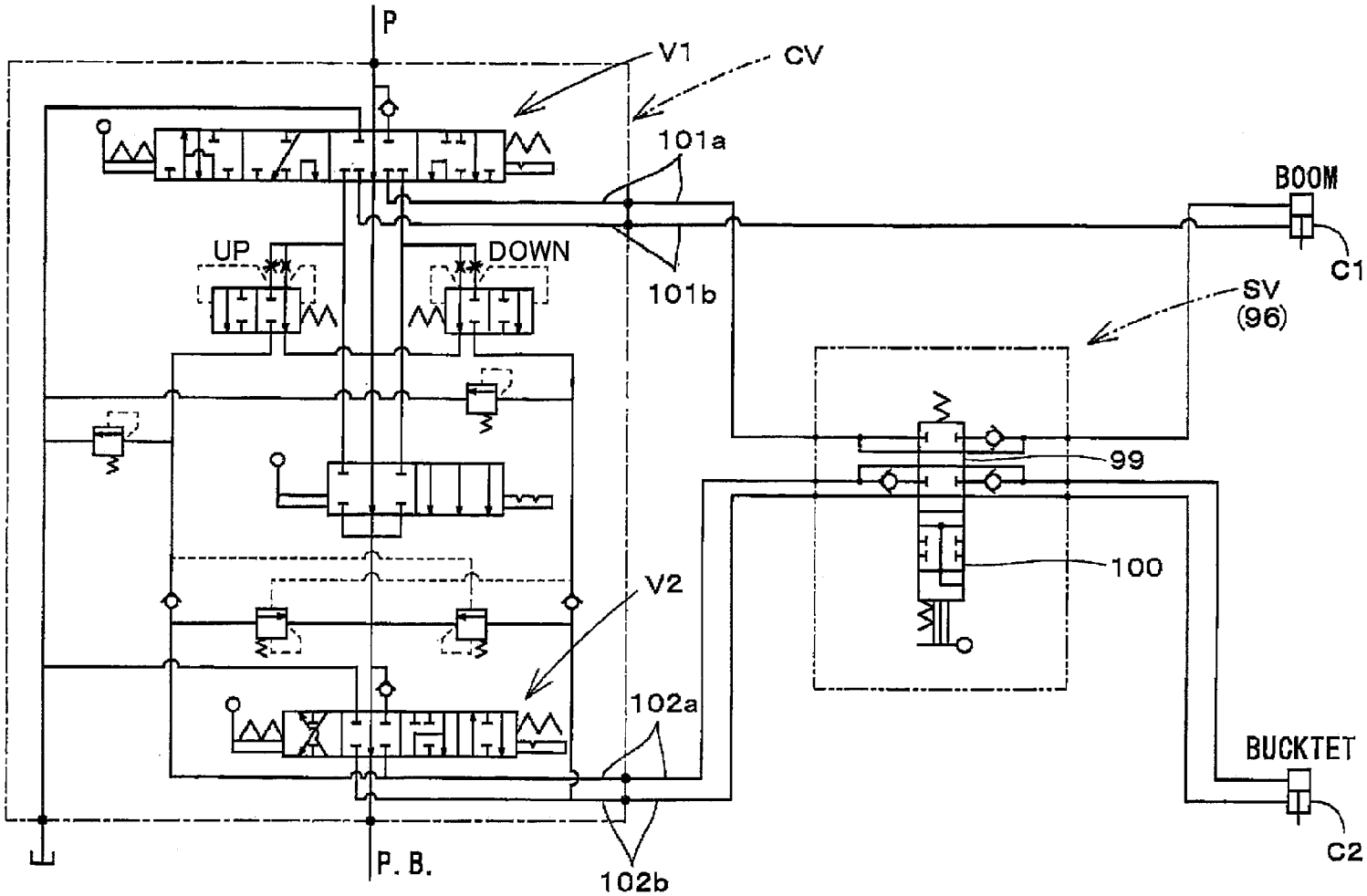
FIG. 19 is a hydraulic circuit diagram.

As shown in FIG. 19, the spill guard valve SV is disposed on a hydraulic route between the bucket cylinder C2, and a loader control valve CV for controlling the boom cylinder C1 and the bucket cylinder C2.

The loader control valve CV is provided on the tractor 2 side. As shown in FIG. 19, the loader control valve CV includes a boom control valve V1 for controlling the boom cylinder C1; and a bucket control valve V2 (work implement control valve) for controlling the bucket cylinder C2. The control valves V1, V2 are manually operated by a manipulating means such as a control lever.

Figure 18:
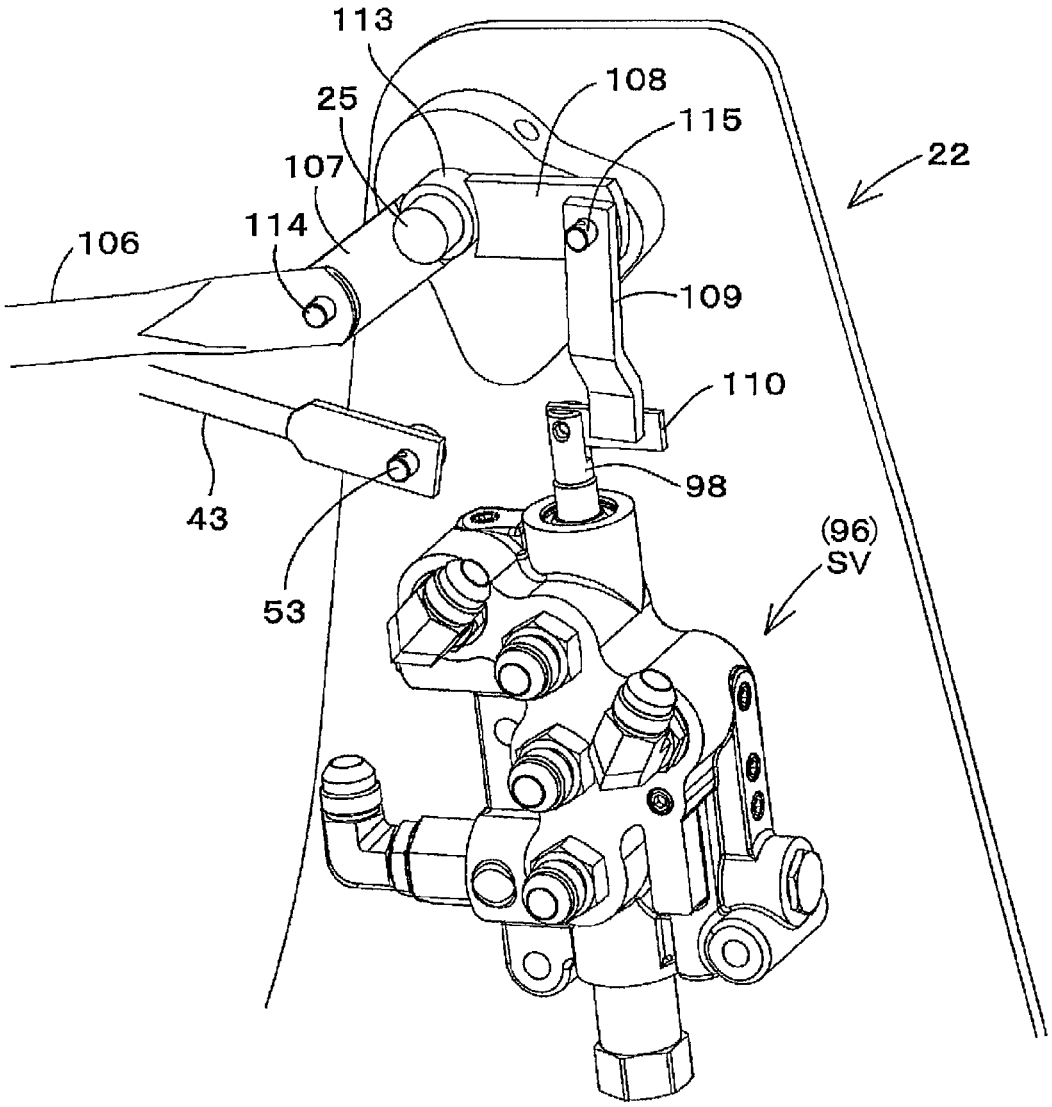
FIG. 18 is a perspective view of respective portions of the indicator device and the spill guide control device.

As shown in FIG. 19, the spill guard valve SV comprises a two-position switching valve of a linear motion spool type, projecting a spool 98 upward (see FIG. 18). Pushing down the spool 98 switches the spill guard valve SV from a neutral position 99 to a control position 100; and a return spring returns the spill guard valve SV to the neutral position 99.

A hydraulic pipe line 101*a* extending from the boom control valve V1 to a bottom side (upward side) of the boom cylinder C1, a hydraulic pipe line 102*a* extending from the bucket control valve V2 to a bottom side (dump side) of the bucket cylinder C2, and a hydraulic pipe line 102*b* extending from the bucket control valve V2 to a rod side (scoop side) runs through the spill guard valve SV; while a hydraulic pipe line 101*b* extending from the boom control valve V1 to a rod side (downward side) of the boom cylinder C1 is disposed without running through the spill guard valve SV.

As shown in FIGS. 15 and 16, the spill guard operating mechanism 97 is provided on the left side of the right boom 23, that is on one side of the boom 23 providing the indicator device 39 for maintaining the bucket posture.

The spill guard operating mechanism 97 comprises: the work implement interlocking mechanism 46 of the indicator device 39 for maintaining the bucket posture; an engaging portion 103 provided at the work implement interlocking mechanism 46; and a valve operating mechanism 104 for operating the spill guard valve SV by coming into engagement with the engaging portion 103. When the spill guard operating mechanism 97 detects that the bottom surface of the bucket 24 reaches a control angle inclined toward the scoop side by a predetermined angle with respect to the horizontal plane (an angle where further inclination of the bucket 24 would fall out the scooped object inside the bucket 24 on the rear side), the spill guard operating mechanism 97 actuates the spill guard valve SV so that the bucket 24 maintains the control angle.

Figure 17:
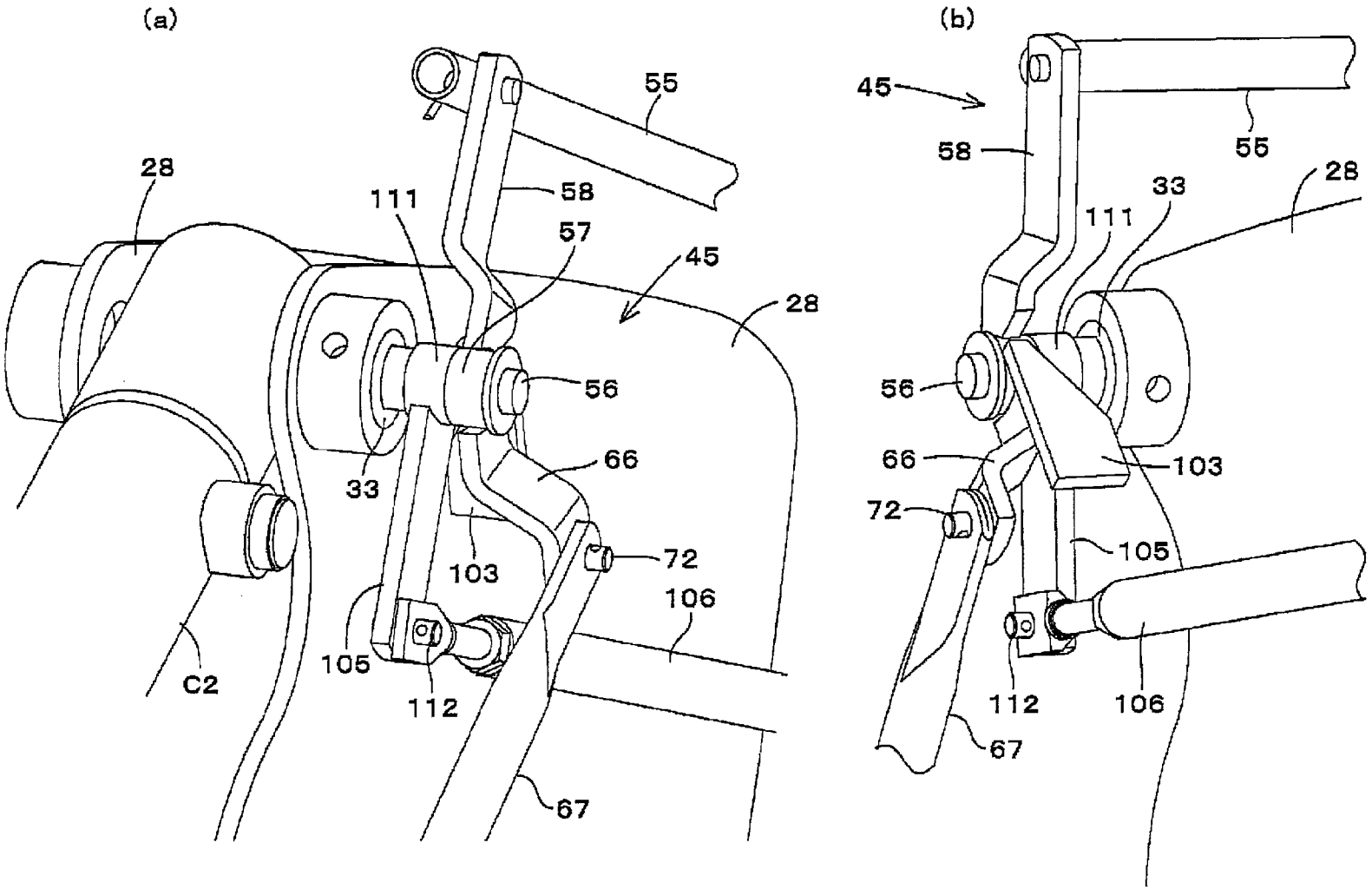
FIG. 17 shows respective intermediate portions of the indicator device and the spill guide control device, in which (*a*) is a front side perspective view and (*b*) is a rear side perspective view.

As shown in FIG. 17 the engaging portion 103 is formed of a plate material, and is provided on a back surface of the third interlocking arm 66 of the work implement interlocking mechanism 46 on the base portion side thereof.

As shown in FIGS. 15 and 16, the valve operating mechanism 104 includes: an engagement arm 105 supported to be rotatable about an axis of the rotating support shaft 56 which is provided on the cylinder support shaft 33 for pivotably supporting the rear end of the bucket cylinder C2; a transmission link 106 having a front end thereof pivotably coupled to the engagement arm 105; a first operating arm 107 having a rear end thereof pivotably coupled to the transmission link 106; a second operating arm 108 rotatable in usison with the first operating arm 107; a spool operating member 109 pivotably coupled to the second operating arm 108; and a spool attaching member 110 fixed to the spool operating member 109.

As shown in FIG. 17, a boss 111 is externally fitted on the rotating support shaft 56 to be rotatable about the axis thereof, and the base portion side of the engagement arm 105 is fixed to the boss 111 to extend downward from the boss 111.

The front end of the transmission link 106 is pivotably coupled to the extending end of the engagement arm 105 via a pin 112. The engagement arm 105 is positioned on the front side of the engaging portion 103.

As shown in FIG. 18, the first operating arm 107 extends downward with a forward inclination from a boss 113, with the base portion side being fixed to the boss 113 which is supported on the boom support shaft 25 (or a shaft extending concentric with the boom support shaft 25) to be rotatable about the axis thereof. The rear end of the transmission link 106 is pivotably coupled to the extending end of the first operating arm 107 via a pin 114.

The second operating arm 108 extends forward from the boss 113, with the base portion side thereof being fixed to the boss 113. One end (the upper end) of the spool operating member 109 is pivotably coupled to the extending end of the second operating arm 108 via a pin 115.

The spool attaching member 110 is fixed to the other end (the lower end) of the spool operating member 109, and the spool attaching member 110 is pivotably coupled to the spool 98 of the spill guard valve SV.

In the spill guard control device 96 of the foregoing configuration, when the bucket 24 is scoop-operated (upwardly operated) in the course of scooping up earth or the like with the bucket 24, then in FIG. 15 the detection link 62 is pushed rearward (the direction of the arrow b1), the first interlocking arm 64 and the second interlocking arm 65 swing in unison, the coupling link 67 is pulled forward (in the direction of the arrow b2), the third interlocking arm 66 swings forward and the engaging portion 103 approaches the engagement arm 105.

With the bucket 24 elevated after scooping earth or the like, when the boom 23 is upwardly operated without manually operating the bucket 24, the bucket 24 inclines to the scoop side with respect to the horizontal plane (a bucket incline angle formed between the horizontal plane and the bottom surface of the bucket 24 is increased).

However, when the boom 23 is upwardly operated, the rotating support shaft 56 goes away from the pin 114 at the rear end of the transmission link 106, and therefore the engagement arm 105 swings rearward (in the direction of the arrow d1) and the engagement arm 105 abuts against (comes into engagement with) the engaging portion 103. After the engagement arm 105 has abutted against the engaging portion 103, swinging motion of the engagement arm 105 in the direction of the arrow d1 is regulated by the engaging portion 103, and therefore upward swinging of the boom 23 is accompanied by forward pulling operation of the transmission link 106 (in the direction of the arrow d2). whereby, the first operating arm 107 swings upward and the second operating arm 108 swings downward to push down on a spool operating member 109. This causes the spool 98 of the spill guard valve SV to be inwardly pushed on via the spool attaching member 110.

When the spool 98 of the spill guard valve SV is pushed in, the spill guard valve SV is switched from the neutral position 99 to the control position 100; and when the spill guard valve SV is switched to the control position 100, a portion of the hydraulic oil supplied to the bottom side (upward side) of the boom cylinder C1 is supplied to the rod side (scoop side) and the bottom side (dump side) of the bucket cylinder C2. Then, the difference in surface area between the rod side and the bottom side of the piston of the bucket cylinder C2 causes the bucket cylinder C2 to extend and causes the bucket 24 to be automatically dump-operated.

The automatic dump-operation of the bucket 24 in association with the upward operation of the boom 23 prevents scooped object, such as earth inside the bucket 24, from falling out. More specifically, when the operator elevates the boom 23 without operating the bucket 24, the elevating of the boom 23 is accompanied by a gradual rearward inclination of the bucket 24. However, before the scooped object such as earth or sand inside the bucket 24 falls out rearward, the spill guard valve SV is actuated and the bucket 24 is automatically dump-operated (downward operated), thereby preventing the scooped object inside the bucket 24 from falling out.

On the other hand, when the upward operation of the boom 23 is stopped, the dumping operation of the bucket 24 is stopped also.

More specifically, when the bucket 24 is dump-operated, the detection link 62 is pulled forward (in the direction of the arrow a1), the first interlocking arm 64 and the second interlocking arm 65 swing in unison, the coupling link 67 is pushed rearward (in the direction of the arrow a2), and the third interlocking arm 66 swings rearward. When the third interlocking arm 66 swings rearward, the engaging portion 103 moves in the rearward direction away from the engagement arm 105. Then, the engagement arm 105 can swing rearward, and therefore the force pushing in on the spool 98 is released, the spool 98 is pushed upward under the urging force of the return spring, the second operating arm 108 swings upward and the first operating arm 107 swings downward via the spool attaching member 110 and the spool operating member 109, and the transmission link 106 is pulled rearward.

When the spool 98 of the spill guard valve SV is pushed upward and returns to the neutral position 99, the supply of hydraulic oil to the bucket cylinder C2 is stopped and the dumping operation of the bucket 24 stops.

On the other hand, when the bucket 24 is scoop-operated without swinging the boom 23, the detection link 62 is pushed rearward in the direction of the arrow b1), the first interlocking arm 64 and the second interlocking arm 65 swing in unison, the coupling link 67 is pulled forward (in the direction of the arrow b2), the third interlocking arm 66 swings forward (in the direction of the arrow d3), and the engaging portion 103 approaches the engagement arm 105 and pushes on the engagement arm 105. Then, the transmission link 106 is pulled forward (in the direction of the arrow d2); the spool 98 of the spill guard valve SV is pushed in on via the first operating arm 107, the second operating arm 108, the spool operating member 109 and the spool attaching member 110; and the spool 98 is operated in the direction of switching from the neutral position 99 to the control position 100.

The spill guard valve SV is completely switched to the control position 100 just before the bucket 24 rotates by a predetermined angle in the scoop direction and the incline angle of the bucket 24 with respect to the horizontal plane reaches an angle where the scooped object such as earth or sand would fall from the bucket 24. When the spill guard valve SV is completely switched to the control position 100, the flow passage of the hydraulic oil being supplied via the hydraulic pipe line 102*b* to the rod side (upward side) of the bucket cylinder C2 from the bucket control valve V2 is shut off, and the scooping operation of the bucket 24 is stopped.

At this time, a dump-operation of the bucket 24 by the bucket control valve V2 is allowed.

In the second embodiment, a portion of the spill guard control device 96 is used also as a portion of the indicator device 39 (i.e. the work implement interlocking mechanism 46). Therefore, the number of components can be reduced as well as costs, and the exterior can be simplified when providing the front loader 3 with the indicator device 39 for maintaining the bucket posture and the spill guard control device 96 for preventing the spilling out of scooped object.

Third Embodiment

FIGS. 20 to 24 show a third embodiment.

The third embodiment is different from the first embodiment in that: in addition to the above-described indicator device 39 for maintaining the bucket posture, the front loader 3 further includes a second indicator device 116 for indicating that the bucket 24 is in a horizontal posture only when the bucket 24 is at a position in contact with the ground, and that a portion of the configuration for the second indicator device 116 acts also as a portion of the configuration for the indicator device 39 for maintaining the bucket posture.

Figure 20:
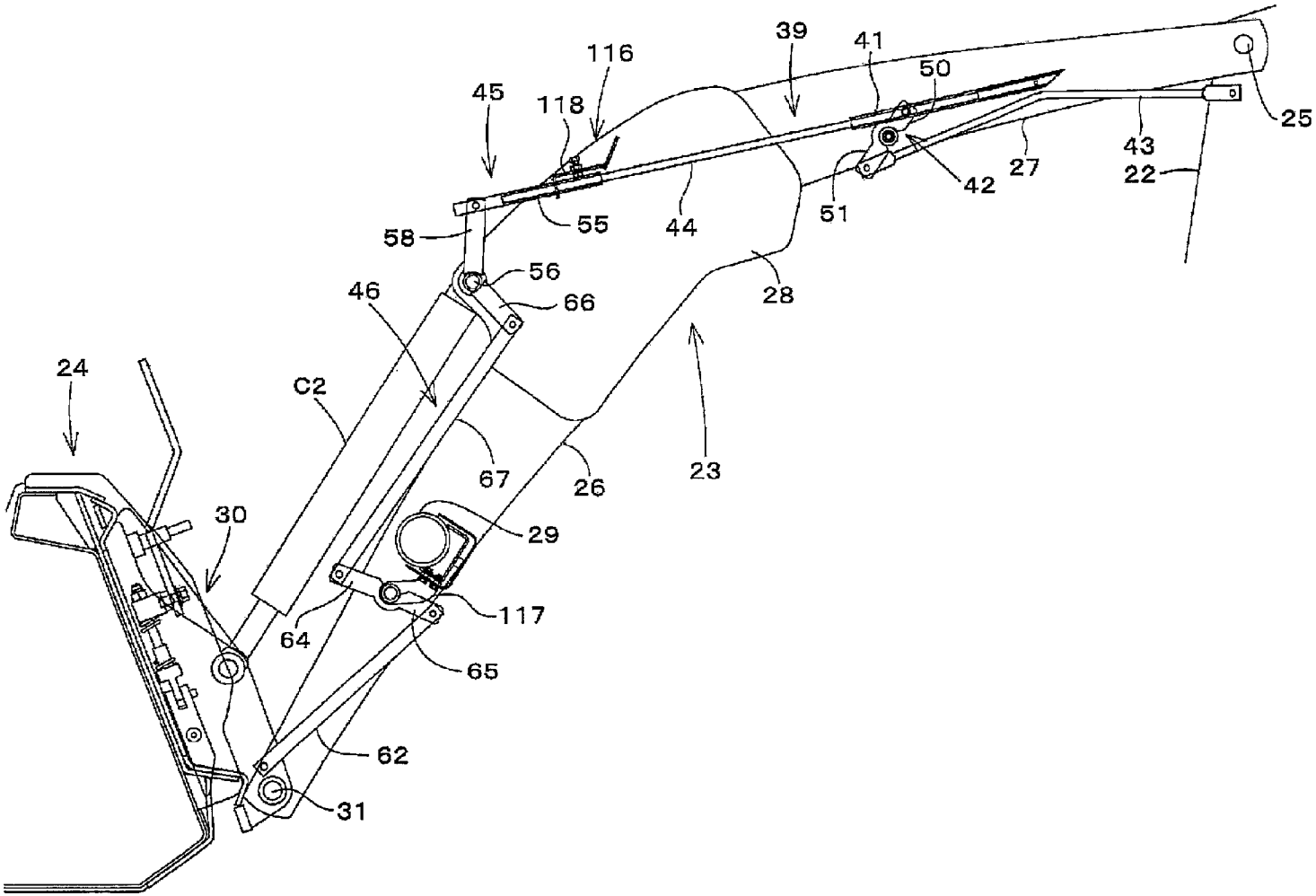
FIG. 20 is a side view showing an indicator device according to a third embodiment (same through to FIG. 24)
Figure 21:
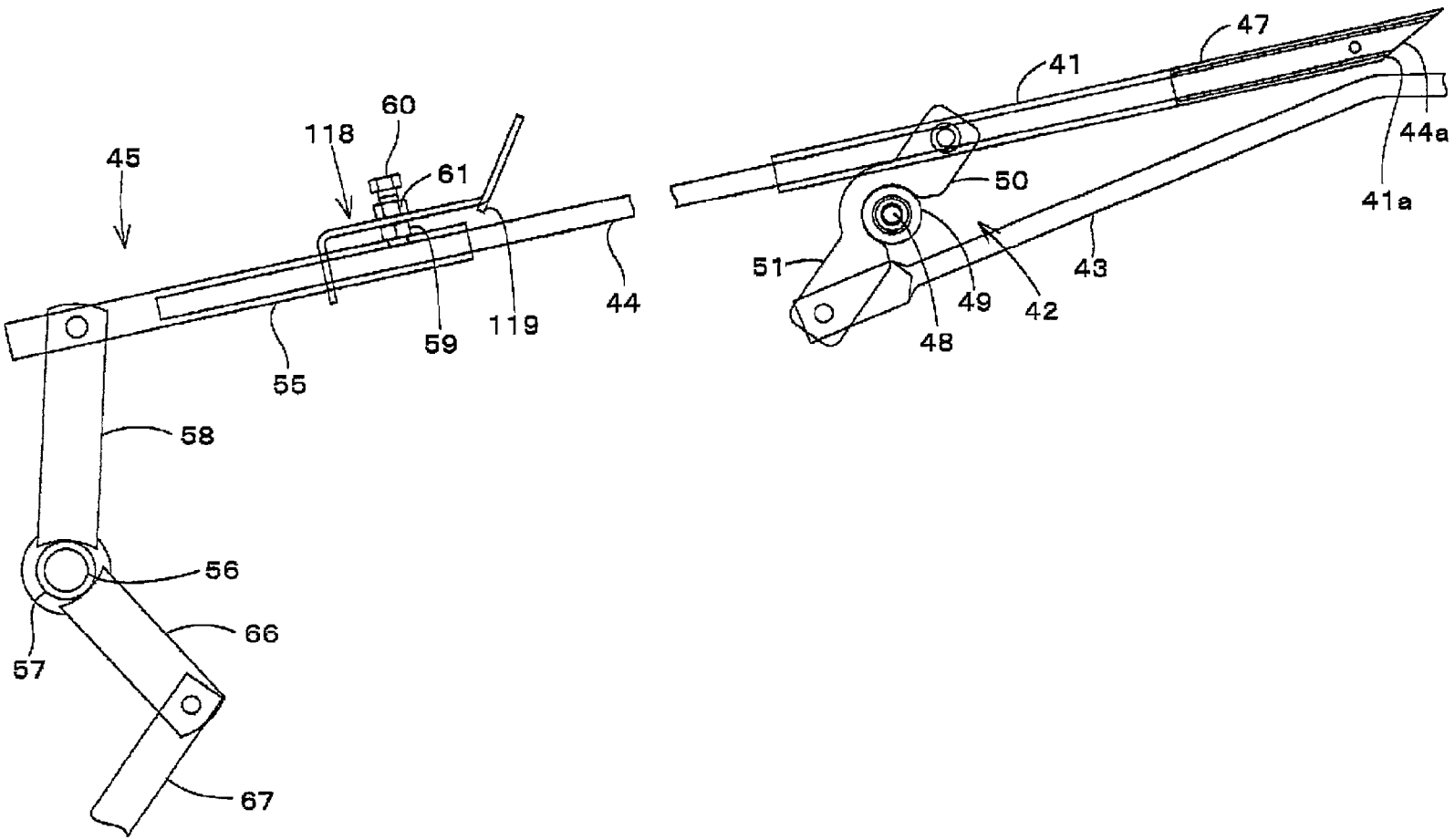
FIG. 21 is a side view showing a portion of the indicator device.

As shown in FIG. 20, in the front loader 3 according to the third embodiment, the front end of the bucket cylinder C2 is pivotably coupled to the work implement mounting frame 30.

Also, in the indicator device 39 for maintaining the bucket posture in the third embodiment, the front end of the detection link 62 is pivotably coupled to a portion upward of a work implement pivot support shaft 31 of the work implement mounting frame 30.

The first interlocking arm 64 and the second interlocking arm 65 of the work implement interlocking mechanism 46 are integrally formed of a single sheet of a plate material, and the rotating support shaft 63 for supporting the first interlocking arm 64 and the second interlocking arm 65 is provided at a bracket 117 which is fixed to the boom coupling member 29 for coupling the right and left front boom members 26.

The support arm 50 and the rotating arm 51 of the tube support mechanism 42 are also integrally formed of a single sheet of a plate material.

The notch portion (cutaway portion) 47 of the rear end of the guide tube 41 is formed longer in the axial direction of the guide tube 41 than that of the first embodiment.

The other configurations are substantially similar to those in the first embodiment.

As shown in FIG. 20, the second indicator device 116 includes: the work implement interlocking mechanism 46, the rod support mechanism 45, an index member 118 and a mark member 119. Thus, the second indicator device 116 shares, with the (first) indicator device 39, the work implement interlocking mechanism 46 and the rod support mechanism 45 of the indicator device 39 for maintaining the bucket posture.

Figure 22:
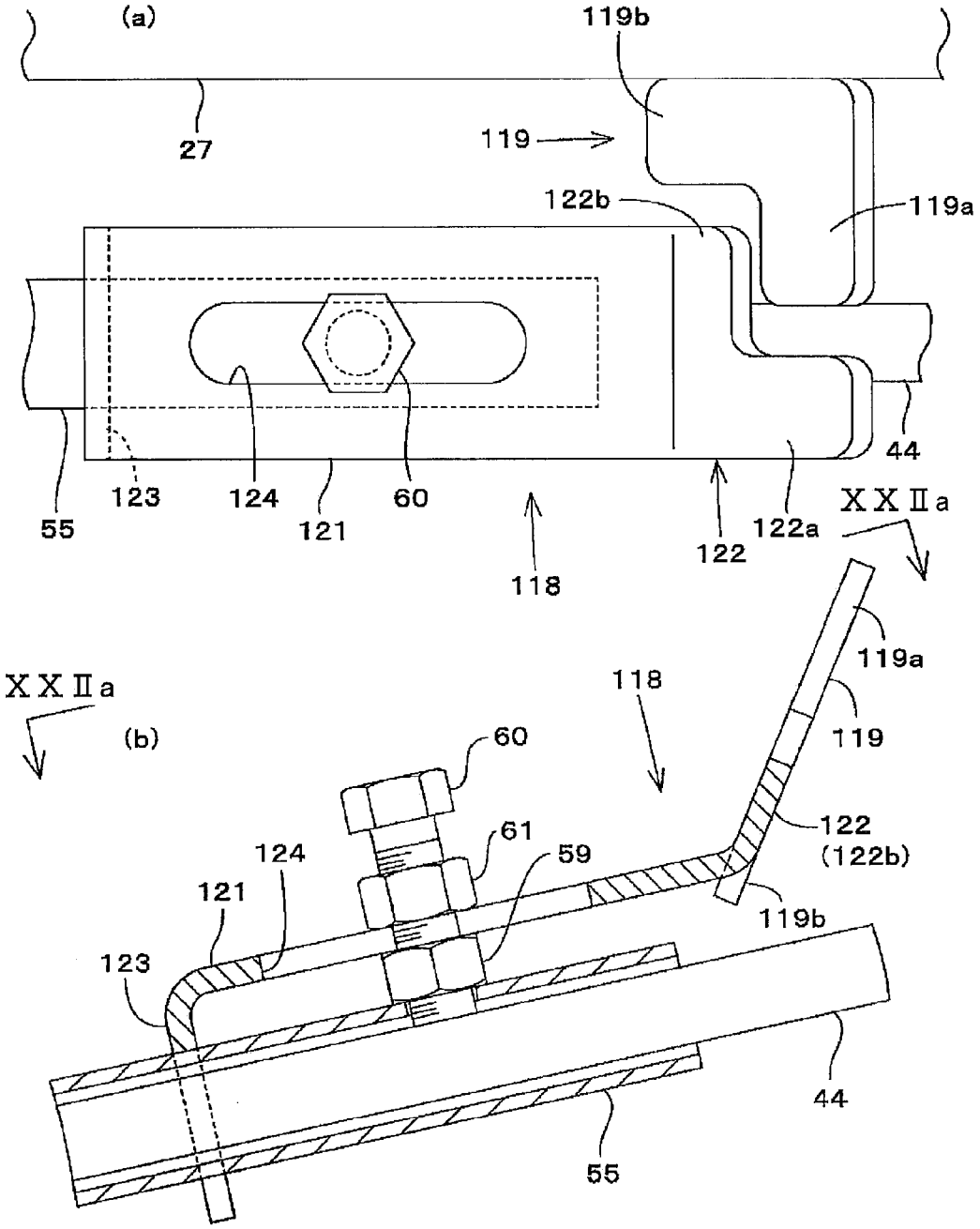
FIG. 22 shows portions of the indicator device, in which (*a*) is a perspective view taken along line XXIIa-XXIIa in FIG. 22(*b*), and (*b*) is a side view of an index member and a mark member showing in partial section.

The index member 118 is formed of a plate material. As shown in FIG. 22, the index member 118 comprises: an attachment wall 121 positioned above the rearward portion of the rod support member 55 of the rod support mechanism 45; an index wall 122 (index portion) extending rearward and upward from the rear end of the attachment wall 121; and a mating wall 123 extending downward from the front end of the attachment wall 121. The index member 118 is formed by bending a single sheet of a plate material.

The attachment wall 121 is attached and fixed to the rod support member 55 by the fixing bolt 60 for fixing the indicator rod 44. More specifically, the attachment wall 121 is inserted between the nut member 59 and the locknut 61, and is fixed by screwing and inserting the fixing bolt 60 into the locknut 61 and also extending the fixing bolt 60 through a bolt insertion hole 124 formed in the attachment wall 121 to screw and insert the fixing bolt into the nut member 59.

The bolt insertion hole 124 for receiving the fixing bolt 60 comprises an elongated slot which is elongated in the axial direction of the rod support member 55, so that the position of the attachment wall 121 (the index member 118) can be adjusted in the axial direction with respect to the rod support member 55.

The index wall 122 is formed in an L-shape, where the transverse width of the upper portion 122*a* is formed to be narrower than the transverse width of the lower portion 122*b*, and where the upper portion 122*a* extends inward in the transverse direction (toward the left) of the lower portion 122*b*.

The mating wall 123 is formed in a forked shape for mating with the rod support member 55 from above so as to straddle the rod support member 55, to prevent the index member 118 from rotating about the fixing bolt 60.

The mark member 119 is formed of a plate material. The mark member 119 is fixed to a longitudinal intermediate portion of the left side surface of the right boom 23 and projecting leftward therefrom. The mark member 119 is formed in an L-shape where the transverse width of the upper portion 119*a* is broader than the transverse width of the lower portion 119*b*.

Figure 23:
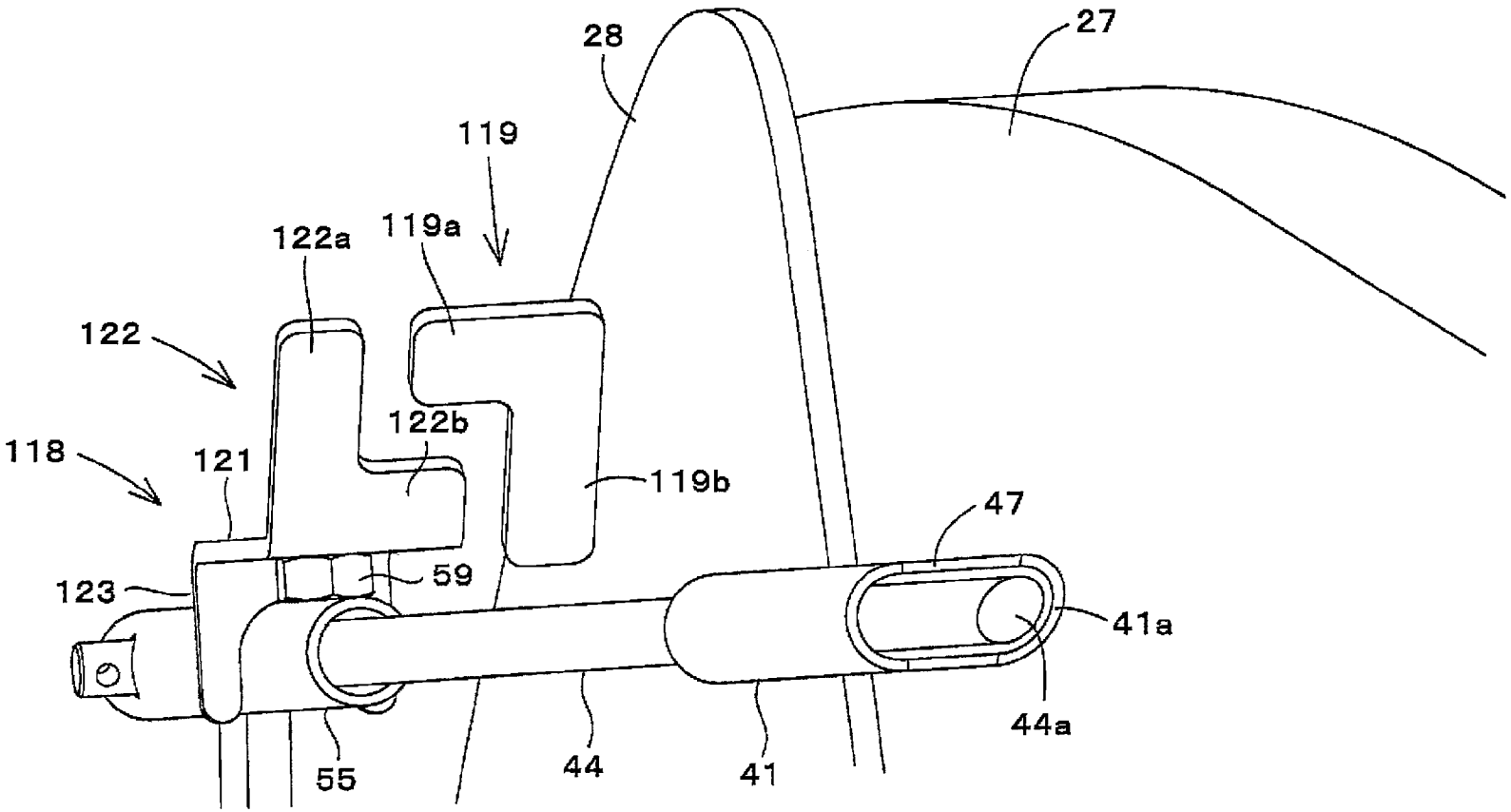
FIG. 23 is a rear side perspective view of the index member and the mark member.

As shown in FIG. 20, the mark member 119 is provided so as to be positioned side by side (in juxtaposition) with the index wall 122 in the transverse direction (that is, the positions of the mark member 119 and the index wall 122 come into alignment with each other in the longitudinal direction of the boom 23) when the bucket 24 becomes in a horizontal posture in contact with the ground. As shown in FIGS. 22 and 23, when the mark member 119 and the index wall 122 becomes arranged side by side with each other in the transverse direction, the upper portion of the mark member 119 enters a recessed portion on the upper portion of the index wall 122.

As described above in the first embodiment, when the bucket 24 is swung, the rod support member 55 moves in the axial direction thereof, and therefore the index member 118 also moves in the axial direction together with the rod support member 55. As such, moving the index member 118 together with the rod support member 55 in the axial direction to adjust the position thereof makes it possible for the index wall 122 of the index member 118 and the mark member 119 to be arranged side by side with each other in the transverse direction.

Arranging the index wall 122 and the mark member 119 side by side with each other in the transverse direction is carried out by the operator visually observing from behind the rear surface of the index wall 122 and the rear surface of the mark member 119.

Figure 24:
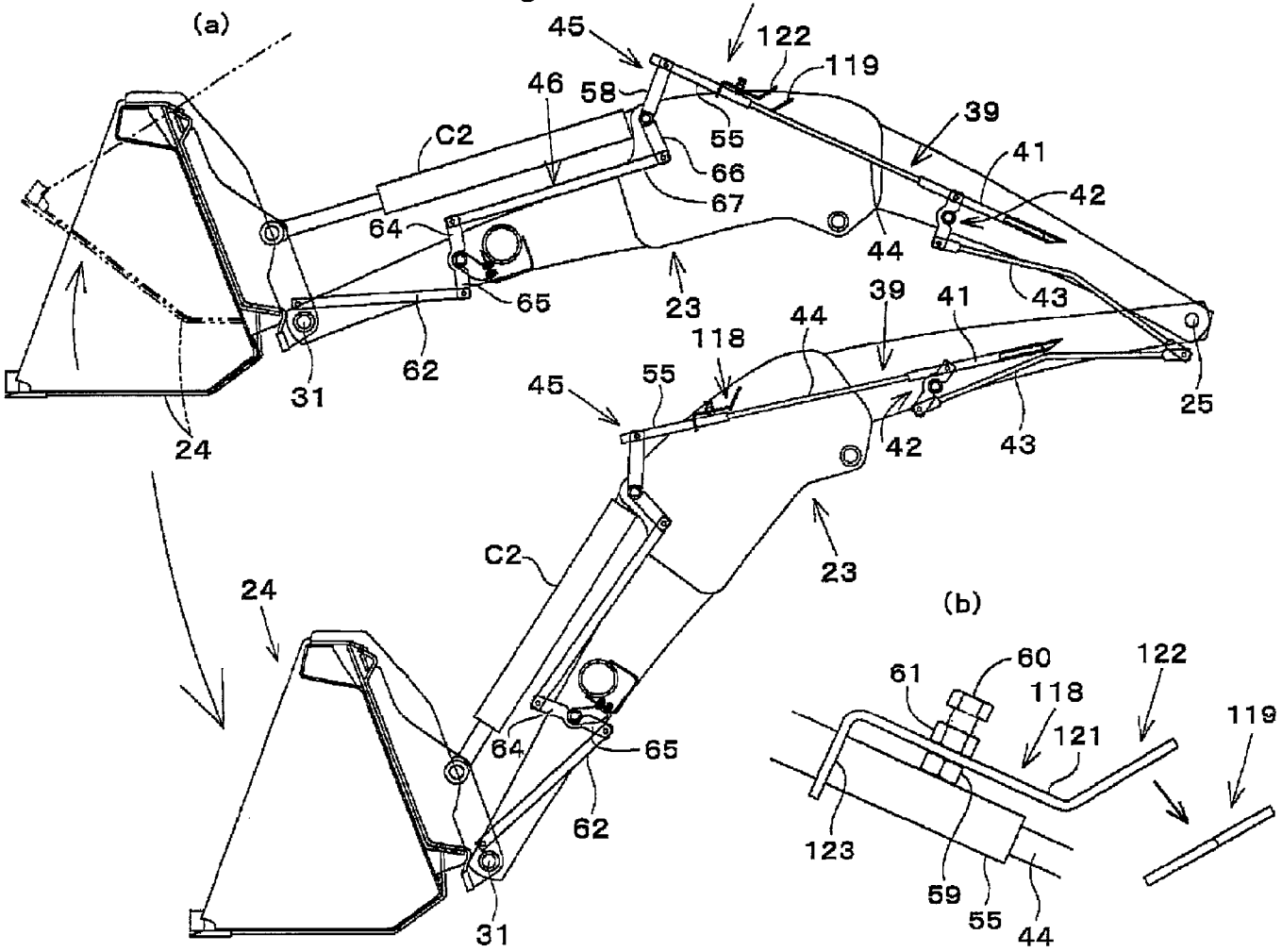
FIG. 24 shows operations of the indicator device.

As shown in FIG. 24, when the operator is to lower the bucket 24, which is elevated from the ground, into contact with the ground in a horizontal posture, this operation is carried out by using the second indicator device 116.

More specifically, if the bucket 24 is in a horizontal posture as shown in FIG. 24 when the bucket 24 is lifted upward from the ground, for example, then, the index wall 122 is deviated forward from the mark member 119. Therefore, the bucket 24 is scoop-operated so as to move the index wall 122 rearward to align the index wall 122 with the mark member 119 in the longitudinal direction of the boom 23. When the boom 23 is thereafter lowered to bring the bucket 24 into contact with the ground, the bucket 24 can be easily brought into contact with the ground in a horizontal posture.

When the operator is to use the indicator device 39 for maintaining the bucket posture when he/she lowers the bucket 24 from its elevated state from the ground and brings the bucket 24 into contact with the ground in a horizontal posture, the operator has to do this work at all times while viewing the rear end of the indicator rod 44.

Further, since the position of the index member 118 can be adjusted in the axial direction with respect to the rod support member 55, the index member 118 can be used also when another work implement (a distal end attachment) is attached instead of the bucket 24. More specifically, if the index wall 122 and the mark member 119 are arranged side by side with each other in the transverse direction when another work implement is attached, and if the attached work implement is not brought into contact with the ground in a horizontal posture, then, the attached work implement is swung and adjusted into contact with the ground in a horizontal posture, and in this state, the position of the index member 118 is adjusted so as to be arranged side by side in the transverse direction with the mark member 119.

In the third embodiment, the second indicator device 116 shares some components (i.e. the work implement interlocking mechanism 46 and the rod support mechanism 45) with the indicator device 39 for maintaining the bucket posture. Therefore, the structure can be simplified and becomes inexpensive. Also, an inexpensive attachment structure is adopted, since the fixing bolt 60, the nut member 59 and the like are used for the attachment for fixing the indicator rod 44 to the rod support member 55.

Fourth Embodiment

FIGS. 25 to 30 show the front loader 3 according to the fourth embodiment.

In the front loader 3 according to this embodiment, the indicator device 39 for maintaining the bucket posture, and the spill guard control device 96 are provided independently of each other.

In this embodiment, the work implement interlocking mechanism 46 is a component of the spill guard operating mechanism 97, and does not form a component of the indicator device 39.

Figure 27:
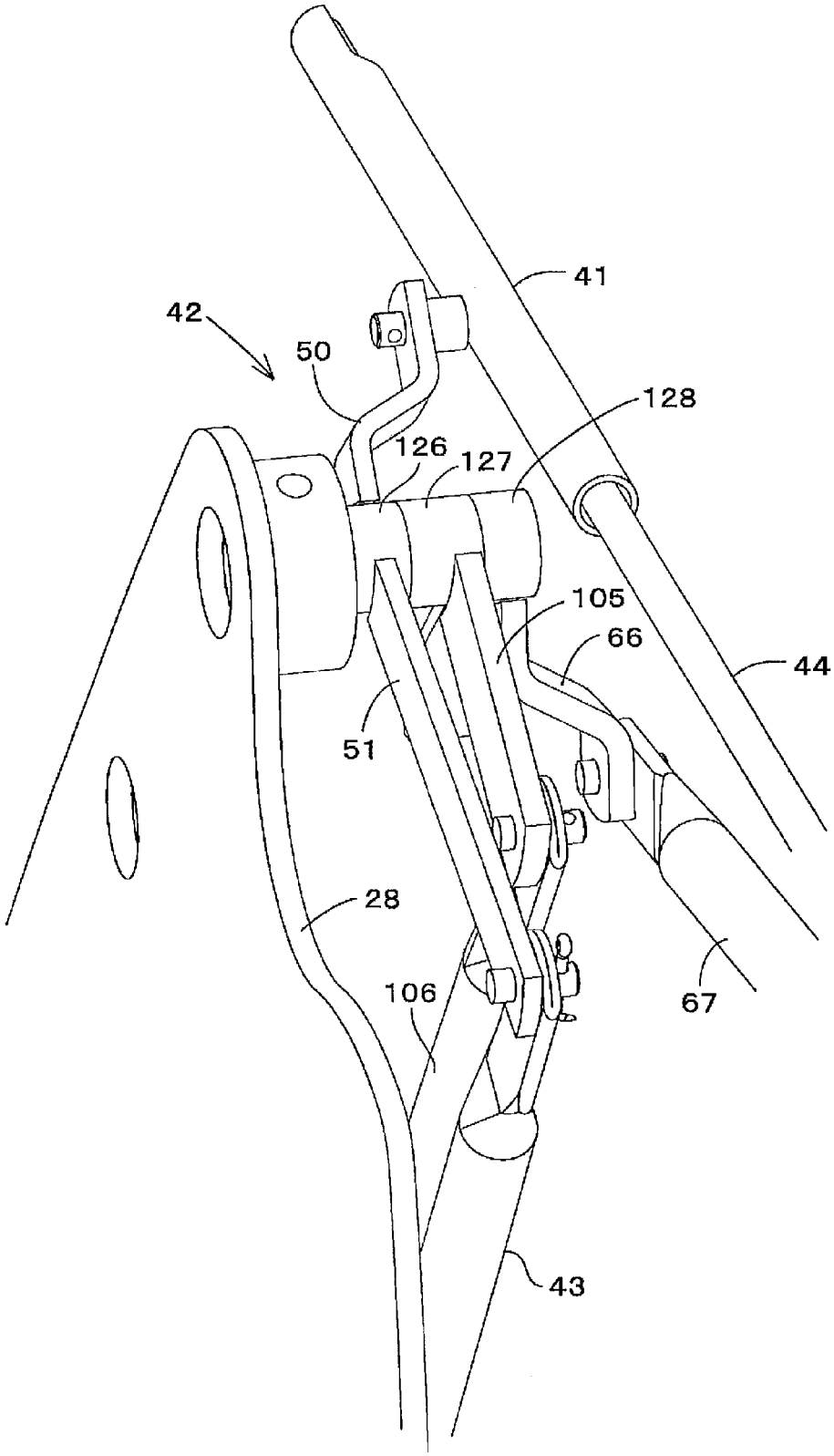
FIG. 27 is a perspective view showing a portion of the indicator device and of the spill guide control device.
Figure 28:
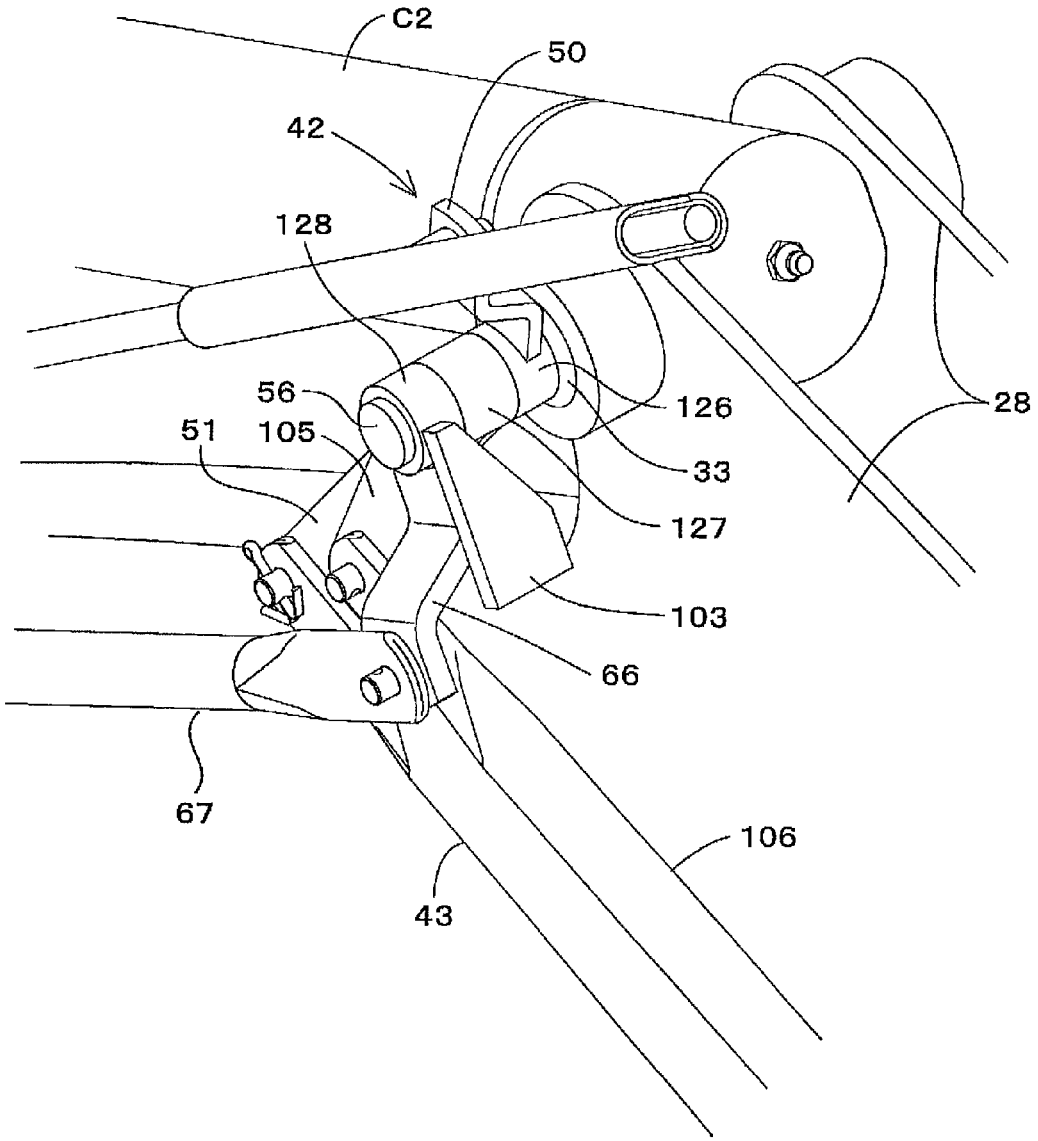
FIG. 28 is a perspective view showing a portion of the indicator device and of the spill guide control device.

As shown in FIGS. 27 and 28, first through third bosses 126, 127, 128 are arranged side by side in the transverse direction and externally fitted on the rotating support shaft 56 which is provided at the cylinder support shaft 33 for pivotably supporting the rear end of the bucket cylinder C2, so that the first through third bosses 126, 127, 128 are rotatable in the axial direction of the rotating support shaft 56.

The support arm 50 and the rotating arm 51 of the tube support mechanism 42 for supporting the guide tube 41 are fixed to the first boss 126; the engagement arm 105 is fixed to the second boss 127; and the third interlocking arm 66 is fixed to the third boss 128.

Figure 25:
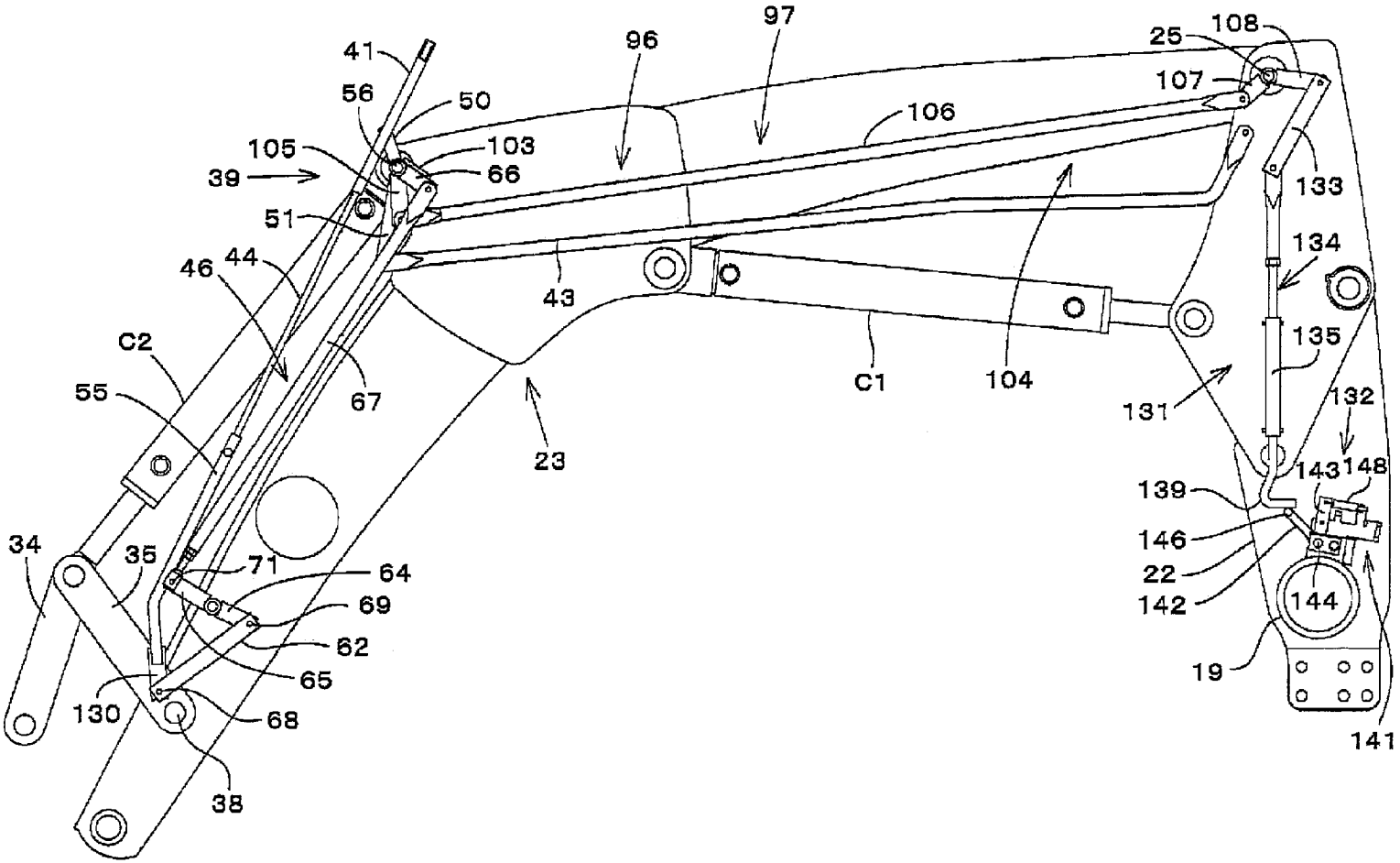
FIG. 25 is a side view showing an indicator device and a spill guide control device according to a fourth embodiment (same through to FIG. 30)
Figure 26:
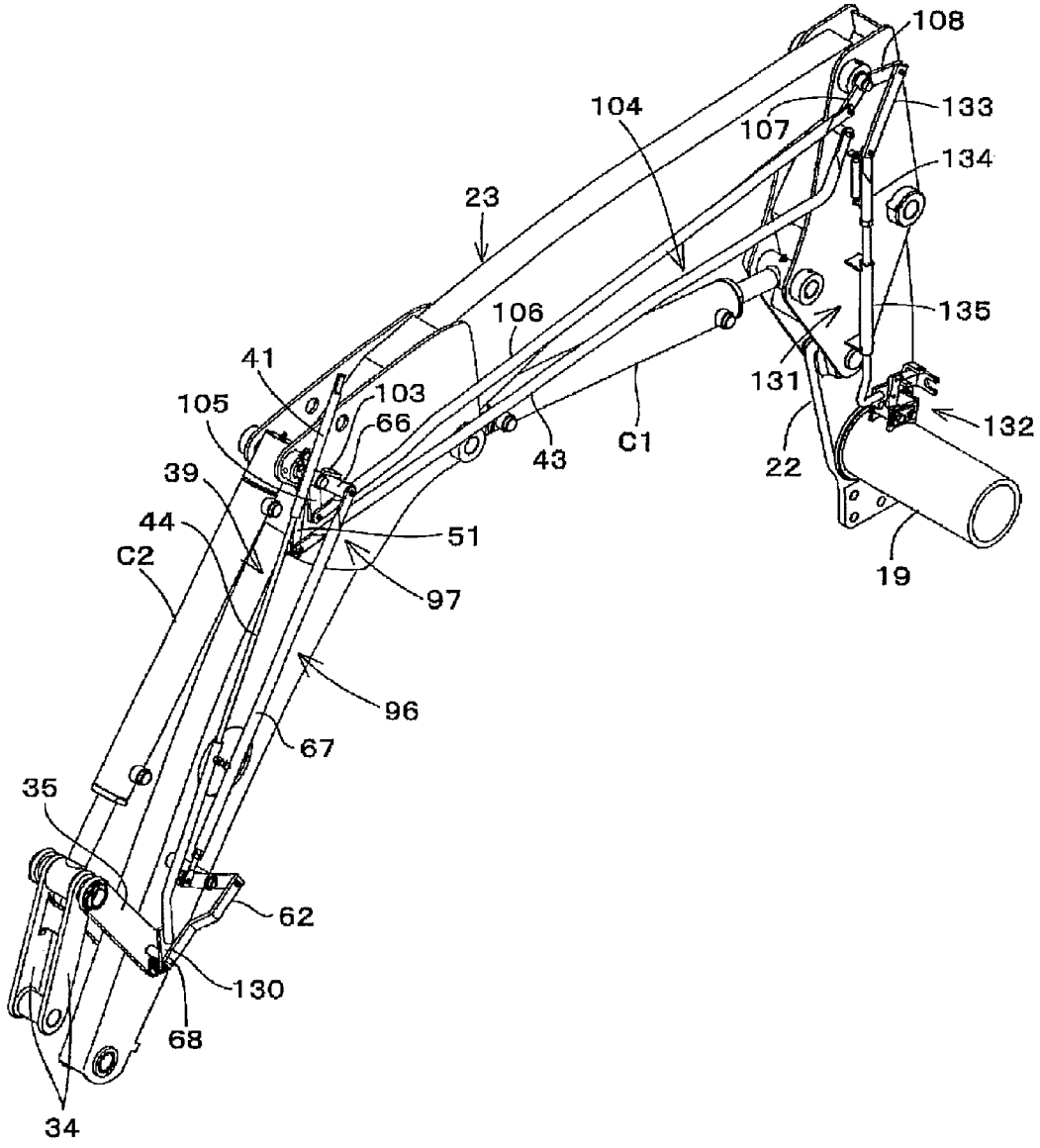
FIG. 26 is a perspective view showing the indicator device and the spill guide control device.

As shown in FIGS. 25 and 26, in the indicator device 39 for maintaining the bucket posture according to this embodiment, the guide tube 41 is provided at the longitudinal intermediate portion of the boom 23. The guide tube 41 is tilted backward, when the boom 23 is lowered to bring the bucket 24 into contact with the ground.

A coupling piece 130 is fixed to the front end of the rod support member 55 which supports the indicator rod 44. The coupling piece 130 is pivotably supported by the link pin 68 which pivotably supports the front end of the detection link 62 of the work implement interlocking mechanism 46.

The rear end surfaces of the indicator rod 44 and the guide tube 41 are cut on respective planes which extend orthogonal to the axial directions thereof.

The spill guard control device 96 according to this embodiment is different from that in the second embodiment in that: the valve operating mechanism 104 of the spill guard operating mechanism 97 is different on the transmission route extending from the second operating arm 108 to the spill guard valve SV; and in that the spill guard valve SV is provided on the tractor 2 side. The other configurations are provided similarly to those in the second embodiment.

The transmission route extending from the second operating arm 108 of the valve operating mechanism 104 to the spill guard valve SV is configured as follows.

Figure 29:
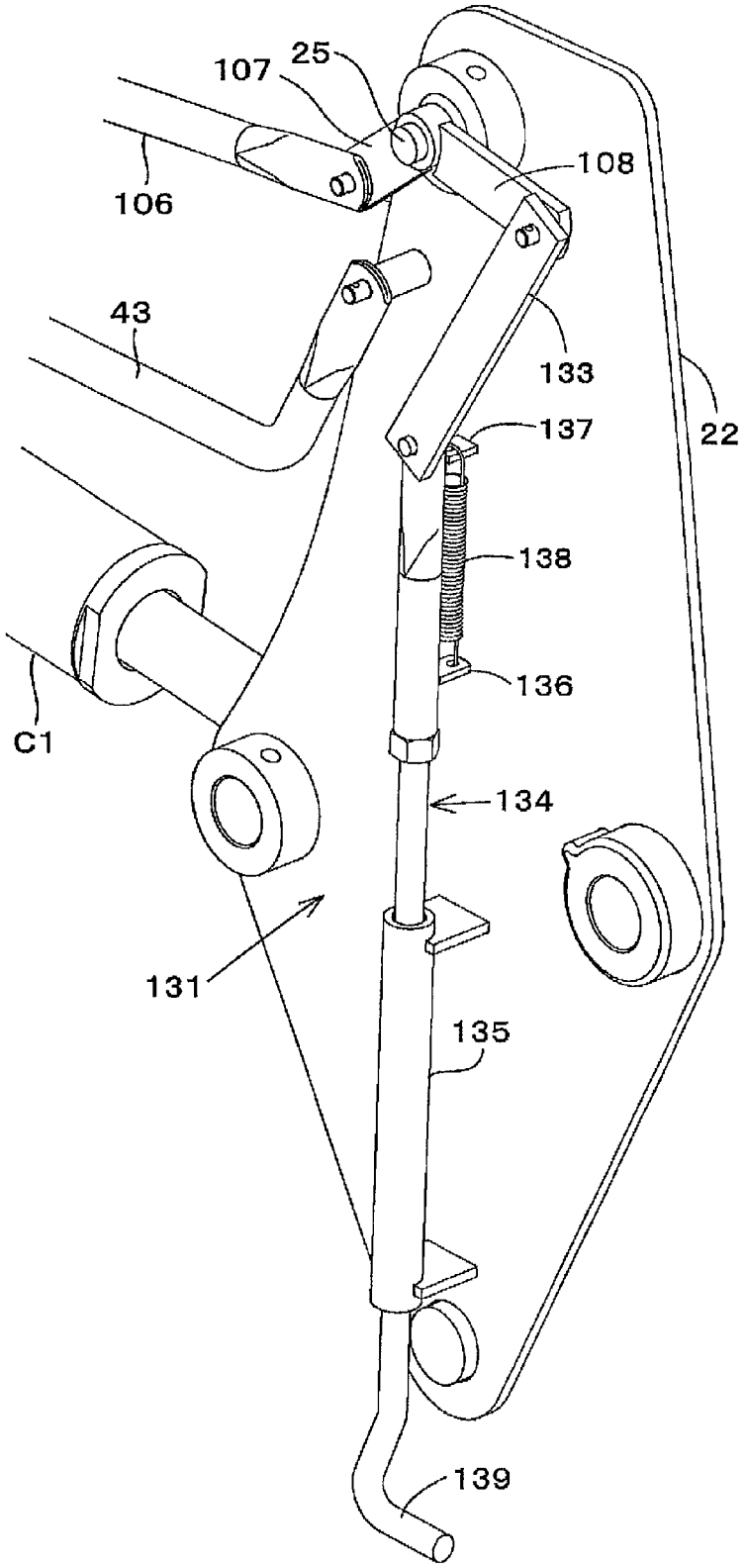
FIG. 29 is a perspective view showing a portion of the indicator device and of the spill guide control device.
Figure 30:
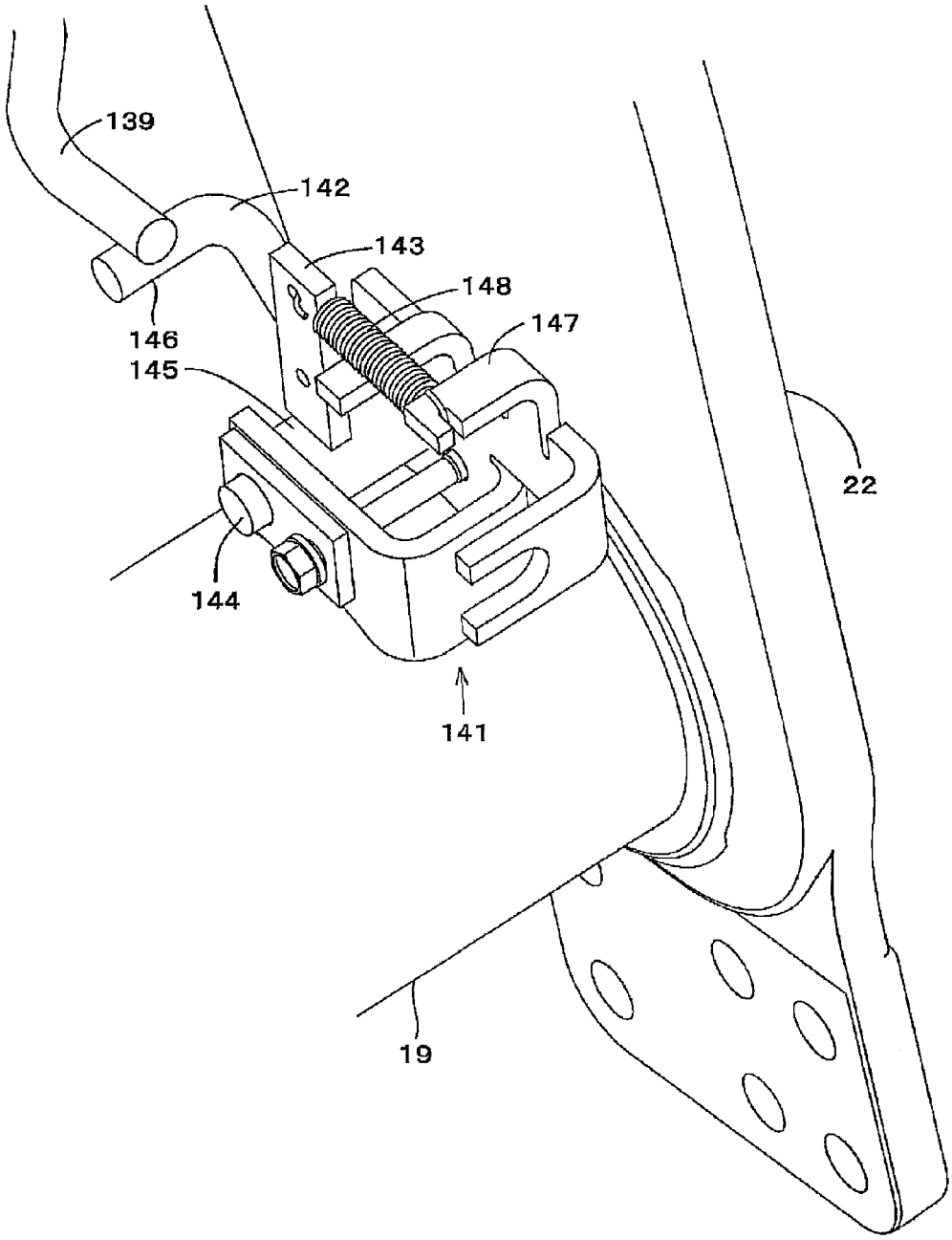
FIG. 30 is a perspective view showing a portion of the indicator device and of the spill guide control device.

Namely, as shown in FIGS. 25, 29 and 30, the transmission route extending from the second operating arm 108 to the spill guard valve SV includes: a transmission mechanism 131 provided on the main frame 22 side; and a relay mechanism 132 for transmission from the transmission mechanism 131 to the spill guard valve SV.

As shown in FIG. 29, the transmission mechanism 131 includes: a transmission link 133 having an upper end thereof pivotably coupled to the second operating arm 108; and a transmission rod 134 having an upper end thereof pivotably coupled to a lower end of the transmission link 133 and extending therefrom downward.

An intermediate portion of the transmission rod 134 is supported and guided by a guide cylinder 135 which is fixed to the main frame 22, so as to be movable up and down. Also, the transmission rod 134 per se is adjustable in its length.

The transmission rod 134 is urged upward by a return spring 138 which is interposed between a spring hook portion 136 provided on the transmission rod 134, and a spring hook portion 137 provided on the main frame 22.

Further, the lower portion of the transmission rod 134 projects downward from the guide cylinder 135, and an abutting portion 139 formed by being bent rearward is provided at the lower end of the transmission rod 134.

As shown in FIG. 30, the relay mechanism 132 includes: a relay bracket 141 fixed onto the support base 19 of the right front loader mounting frame 16; a relay lever 142 pivotably supported by the relay bracket 141 so as to be rotatable about a transverse axis; and a relay arm 143 for rotating in unison with the relay lever 142.

A boss 145 is provided at the forward portion of the relay bracket 141, and is externally fitted on and supported by a support shaft 144 having an axis in the transverse direction, so as to be rotatable about the transverse axis. The intermediate lever 142 is fixed to the boss 145 so as to extend therefrom forward. The front end of the relay lever 142 is bent outward in the transverse direction to form an abutted portion 146. The abutted portion 146 is positioned below the abutting portion 139 of the transmission rod 134 and is configured to abut against the abutting portion 139.

The proximal end of the relay arm 143 is fixed to the boss 145, and therefrom the relay arm 143 extends upward. A return spring 148 is interposed between the upper end of the relay arm 143 and a spring hook portion 147 which is provided on the relay bracket 141. Under the force of the return spring 148, the relay arm 143 is urged to swing rearward, and thus the relay lever 142 is urged to swing upward (into abutment against the abutting portion 139).

One end of a transmission wire (not shown) is coupled to the relay lever 142; and the other end of the transmission wire is operatively coupled to the spool of the spill guard valve SV via an interlocking mechanism.

With the spill guard control device 96 having the configuration as described above in operation, if the operator elevates the boom 23 without operating the bucket 24 and if the engagement arm 105 abuts against the engaging portion 103 to swing the second operating arm 108 downward, then, the transmission rod 134 is pushed downward via the transmission link 133 and the transmission rod 134 pushes the relay lever 142 downward. In response thereto, the relay arm 143 swings forward, and the spill guard valve SV is actuated via the transmission wire, so that the bucket 24 is automatically dump-operated.

The spill guard control device 96 according to the present embodiment as shown in FIGS. 25 to 30 may also be adopted in the second embodiment.

Fifth Embodiment

Figure 31:
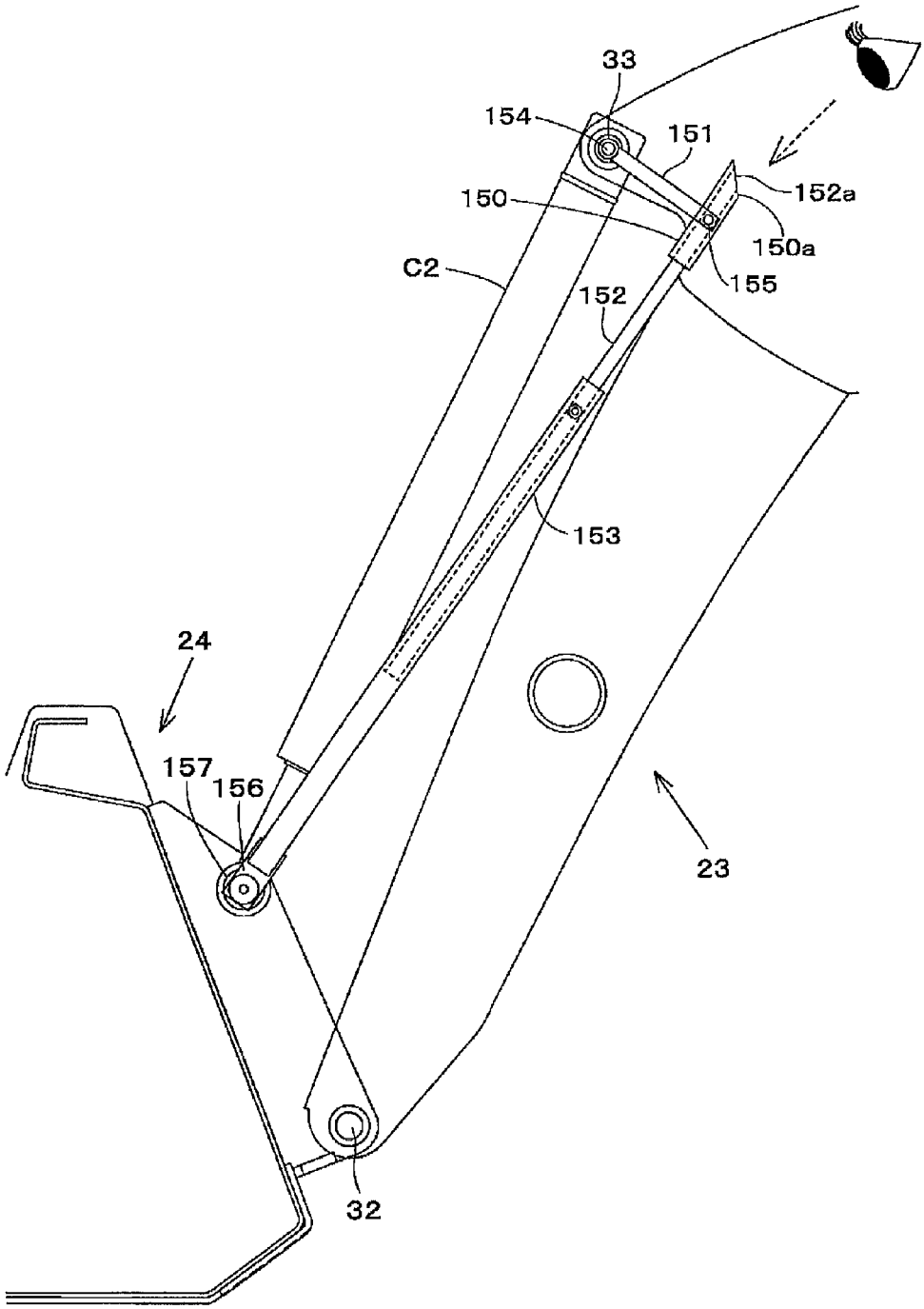
FIG. 31 is a side view of an indicator device according to a fifth embodiment.

FIG. 31 shows a fifth embodiment which is another embodiment of an indicator device 149 for indicating a horizontal posture at a position where the bucket 24 is brought into contact with the ground.

The indicator device 149 comprises: a guide tube 150; a support arm 151 for supporting the guide tube 150; an indicator rod 152 having a rear end thereof inserted into the guide tube 150; and a cylindrical rod support member 153 for supporting the indicator rod 152.

The support arm 151 has one end thereof pivotably supported by a support shaft 154 which is provided at the cylinder support shaft 33 for pivotably supporting the rear end of the bucket cylinder C2, and has the other end thereof pivotably coupled to the guide tube 150 via a pin 155.

The indicator rod 44 has a front end thereof inserted into and supported by the rod support member 153. The indicator rod 152 is fixed to the rod support member 153 in a similar manner to that of the indicator device 39 according to the first embodiment.

A coupling piece 156 is provided at the front end of the rod support member 153. The coupling piece 156 is pivotably supported by the cylinder support shaft which pivotably supports the front end of the bucket cylinder C2, so that the coupling piece 156 is rotatable about a transverse axis.

With this indicator device for indicating the horizontal posture in operation, too, the indicator rod 152 moves in the axial direction through and relative to the guide tube 150 in association with the swing operation of the bucket 24, so as to align the rear end surface 152*a* of the indicator rod 152 with the rear end surface 150*a* of the guide tube 150 so that the rear end surface 152*a* becomes flush with the rear end surface 150*a*. Whereby, the bucket 24 adopts a horizontal posture in contact with the ground.

Further, the rear end surface 152*a* of the indicator rod 152 and the rear end surface 150*a* of the guide tube 150 are cut on planes inclined with respect to the axial direction, similarly to the indicator device 39 according to the first embodiment. Therefore, this is effective to easy alignment between the rear end surface 152*a* of the indicator rod 152 and the rear end surface 150*a* of the guide tube 150.

What is claimed is:

1. A front loader comprising:

a main frame standing erect in front of the travelling vehicle;

a boom having a rear end thereof pivotably supported at an upper portion of the main frame to be vertically movable;

a work implement pivotably supported at a front end of the boom to effect scooping and dumping operations; and an indicator device for indicating a posture of the work implement, the indicator device including:

a guide tube extending along a longitudinal direction of the boom on a rear portion of the boom;

a tube support mechanism provided on the rear portion of the boom, the tube support mechanism supporting the guide tube so that the guide tube is movable in an axial direction thereof;

a boom interlocking link having a rear end thereof pivotably supported by the main frame and a front end thereof operatively coupled to the tube support mechanism so that the guide tube moves in an axial direction thereof in association with vertical movement of the boom;

an indicator rod inserted into the guide tube to be movable in the axial direction of the guide tube;

a rod support mechanism provided at a longitudinal intermediate portion of the boom for supporting the indicator rod so that the indicator rod is movable in an axial direction thereof; and a work implement interlocking mechanism for interlocking the bucket and the rod support mechanism so that the indicator rod is movable in the axial direction thereof in association with the scooping operation and the dumping operation of the work implement;

wherein the indicator device is configured to indicate that the work implement is in an identical posture irrespective of a height position of the work implement, by aligning a rear end of the indicator rod with a rear end of the guide tube.

2. The front loader according to claim 1, further comprising:

a boom cylinder for hydraulically operating the boom upward and downward;

a work implement cylinder for hydraulically effecting the scooping and dumping operations of the work implement; and a spill guard control device for automatically dump-operating the work implement to prevent scooped object having scooped up by the work implement from falling out of the bucket to the rear side when the boom is being elevated without manually operating the work implement, the spill guard control device including:

a spill guard valve for switching routes of hydraulic oil to automatically dump-operate the work implement;

the work implement interlocking mechanism;

an engaging portion provided at the work implement interlocking mechanism; and a valve operating mechanism for coming into engagement with the engaging portion and actuating the spill guard valve before the work implement reaches a posture in which the scooped object in the work implement will fall out to the rear side.

3. The front loader according to claim 1, further comprising:

a second indicator device for indicating that the work implement is at a horizontal posture where a bottom surface thereof is horizontal with the work implement being in contact with the ground, the second indicator device including:

an index portion provided on the rod support mechanism for moving in unison with the indicator rod; and a mark member provided on the boom side;

wherein the work implement is in contact with the ground in a horizontal posture by scoop-operating or dump-operating the work implement until the index portion comes into alignment with the mark member in the longitudinal direction of the boom, and bringing the work implement into contact with the ground.

4. The front loader according to claim 1, wherein a rear end surface of the guide tube forms an inclined surface with respect to an axis of the guide tube, and a rear end surface of the indicator rod is forms an inclined surface with respect to an axis of the indicator rod, the inclined surface of the indicator rod being flush with to align the rear end surface of the guide tube.

5. The front loader according to claim 1, wherein a notch portion is provided at the rear end of the guide tube by cutting away a portion in the peripheral direction thereof by a predetermined range, forwardly from the rear end.

* * * * *

UNITED STATES PATENT AND TRADEMARK OFFICE

CERTIFICATE OF CORRECTION

PATENT NO. : 9,039,343 B2
APPLICATION NO. : 13/775470
DATED : May 26, 2015
INVENTOR(S) : Ryoichi Nishi et al.

It is certified that error appears in the above-identified patent and that said Letters Patent is hereby corrected as shown below:

In the claims

Column 22, Line 48, Claim 4, after “rod” delete “is”

Signed and Sealed this
Tenth Day of November, 2015

Michelle K. Lee

Michelle K. Lee
*Director of the United States Patent and Trademark Office*